US005168135A

United States Patent [19]

Kubo et al.

[11] Patent Number: 5,168,135

[45] Date of Patent: Dec. 1, 1992

[54] ALLOCATION OF ELEVATOR CAR TO FLOORS INCLUDING CAR DIRECTION REVERSALS WHICH IMPROVE SERVICE

[75] Inventors: Susumu Kubo; Masumi Tsunoda, both of Tokyo, Japan

[73] Assignee: Kabushiki Kaisha Toshiba, Kawasaki, Japan

[21] Appl. No.: 595,818

[22] Filed: Oct. 10, 1990

[30] Foreign Application Priority Data

Nov. 28, 1989 [JP] Japan ..... 1-306441

[51] Int. Cl.[5] ..... B66B 1/18

[52] U.S. Cl. ..... 187/127

[58] Field of Search ..... 187/124, 127, 133; 364/138

[56] References Cited

U.S. PATENT DOCUMENTS

| | | | |
|---|---|---|---|
| 4,081,059 | 3/1978 | Kuzunuki et al. | 187/127 |
| 4,147,235 | 4/1979 | Henry et al. | 187/127 |
| 4,536,842 | 8/1985 | Yoneda et al. | 187/133 |
| 4,672,531 | 6/1987 | Uetani | 364/138 |
| 5,020,642 | 6/1991 | Tsuji | 187/124 |

FOREIGN PATENT DOCUMENTS 1042658 10/1964 United Kingdom .

*Primary Examiner*—A. D. Pellinen
*Assistant Examiner*—Lawrence E. Colbert
*Attorney, Agent, or Firm*—Foley & Lardner

[57] ABSTRACT

A method and an apparatus for elevator group control, capable of improving the transport efficiency without severely lowering the overall quality of service, even when the traffic demand to a particular floor sharply increased in a particular period of time. In the apparatus, the elevator cars of the elevator system are controlled according to the hall call allocation control based on the transport efficiency of the elevator system, such that in a case the response elevator car having an ultimate destination floor is additionally allocated to another floor which is located in an opposite direction from an ultimate destination of the response elevator car, the responds elevator car is controlled to reverse a direction of motion to serve said another floor and then to reverse the direction of motion again to move to the ultimate destination floor.

23 Claims, 25 Drawing Sheets

| |
|---|
| FIG.5a |
| FIG.5b |

START

66
TIMING FOR DEPARTURE ?
NO
YES
67
PRIORITY ALLOCATION ?
NO
YES
68
CAR WEIGHT ≦ THRESHOLD ?
NO
YES
69
PRIORITY ALLOCATION ACCEPTANCE
70
PRIORITY ALLOCATION REJECTION
71
REVERSING DIRECTION OF MOTION TOWARD fp FLOOR
72
REACHED fp FLOOR ?
NO
YES
73
REVERSING DIRECTION OF MOTION TOWARD PARTICULAR FLOOR
74
RESUMING NORMAL OPERATION
END

| FIG.10a |
| --- |
| FIG.10b |

| |
|---|
| FIG.16a |
| FIG.16b |

| |
|---|
| FIG.19a |
| FIG.19b |

ALLOCATION OF ELEVATOR CAR TO FLOORS INCLUDING CAR DIRECTION REVERSALS WHICH IMPROVE SERVICE

BACKGROUND OF THE INVENTION

1. Field of the Invention

The present invention relates to a method and an apparatus for elevator group control by which an elevator system including a plurality of elevator cars and a plurality of destination floors are controlled.

2. Description of the Background Art

Recently, an elevator system including a plurality of elevator cars and a plurality of destination floors is equipped with a microcomputer to administer efficient and speedy allocations of elevator cars to hall calls produced at various destination floors, so as to improve the efficiency of elevator utilization and the quality of service.

Namely, in such an elevator system, when a hall call is produced at a certain floor, an elevator car which is most appropriate to respond to this hall call is selected from the plurality of elevator cars of the system, while the other elevator cars are prohibited to respond to this hall call. Meanwhile, at the hall of the floor from which the hall call is produced, an allocation indication lamp provided in a vicinity of an elevator entrance of the allocated elevator turns on, and an approach of the allocated elevator car is notified by a ringing of a chime and a flashing of the allocation indication lamp.

More recently, due to the development in the field of a micro-computer, such an elevator system is equipped with a function to collect in real time various data such as elevator car call response registration data regarding hall calls to which each elevator car has responded, so as to apprehend traffic demands among the floors of each building, and the elevator group control apparatus utilizes these data to the elevator car allocation control, so as to account for a unique situation characteristic to each building.

Such a conventional elevator group control apparatus is shown in FIG. 1.

This elevator group control apparatus comprises: a group control unit 101 and a plurality (N in number) of elevator car control units 102-1 to 102-N provided in correspondence with N elevator cars incorporated in the elevator system, which are connected through a high speed data transmission line 106.

The apparatus also includes hall call buttons 103 provided on each floor of a building in which the elevator system operates, hall call control units 104 provided for each hall call buttons 103 at each floor, and a monitor unit 105. These hall call control units 104 are connected with the group control unit 101 and elevator car control units 102-1 to 102-N through a low speed data transmission line 107.

The group control unit 101 is usually located in a monitoring room, but a recent elevator system also has a sub group control unit provided in one of the elevator unit of the elevator system, in addition to the main group control unit in the monitoring room, such that this sub group control unit can be substituted for the main group control unit in a case the main group control unit fails.

Next, the operation of this elevator group control apparatus of FIG. 5 will be described.

When a user presses one of the hall call buttons 103 at an n-th floor of the building, the corresponding hall call control unit 104 on the n-th floor sends a hall call signal to the group control unit 101. In response to the reception of this hall call signal from the hall call control unit 104, the group control unit 101 detects the current positions of each elevator car, calculates the estimated response time (an estimated time for an elevator car to reach the n-th floor plus a time elapsed since the hall call has been produced) for each elevator car, and allocates the most appropriate elevator car having a smallest estimated response time to this hall call at the n-th floor.

Here, if the most appropriate elevator car selected by the group control unit 101 is an elevator car No. 1 controlled by the elevator car control unit 102-1, the group control unit 101 sends a command signal for activating this elevator car No. 1 to the elevator car control unit 102-1, while giving a notice signal for notifying that the elevator car No. 1 has been allocated to the hall call control unit 104 at the n-th floor. In response to the reception of this notice signal from the group control unit 101, the hall call control unit 104 at the n-th floor turns on the allocation indication lamp provided in a vicinity of an elevator entrance of the elevator car No. 1, so that the user on the n-th floor can recognize that the elevator car No. 1 is coming in response to the hall call he produced.

Now, in a kind of building which has restaurants on a particular floor, the traffic demands to this floor sharply increases during a particular period of time such as a first half of a lunch break period. For this reason, much higher transport efficiency is required in such a building especially during such a particular period of time. Here, a case of the higher transport efficiency means a case such as that in which, while each elevator car is moving to the particular floor, the intervening floors from which the hall calls are produced and to which this elevator car has been allocated are not passed by for the reason that this elevator car is full, and yet by the time this elevator car reaches to the particular floor, this elevator car is at least nearly full.

In a conventional elevator group control apparatus, such a higher transport efficiency is achieved by estimating a weight to be given to each floor which indicates how important it is for an elevator car to stop at that floor for the sake of a total transport efficiency, in addition to the aforementioned estimated response time, so as to prevent the occurrence of a case in which the elevator car passes by a floor at which it is scheduled to stop for the reason that the elevator car has already been full, as much as possible. In other words, the elevator cars of the elevator system are controlled such that all the elevator cars carry nearly equal number of passengers.

However, such an estimation of a number of passengers in each elevator car is based on a statistical method, so that it cannot account for continuously changing situations around the halls of the elevator system accurately. As a consequence, the conventional elevator group control apparatus often created a situation in which there are many users are kept waiting on several floors, while the elevator cars are reaching to the particular floor with much less than a full number of passengers.

Such a situation will now be described in detail, with reference to FIG. 2.

A situation shown in FIG. 2 is that in which three elevator cars No. 1 to No. 3 are operating between the first floor and the tenth floor, and the hall calls to go to the first floor on which the restaurants are located has been produced at the sixth, ninth, and tenth floors, where each of these floors has a large number of users waiting.

In this FIG. 2, black triangles marked on a passages of the elevator car No. 3 at the sixth, ninth, and tenth floors indicate the hall calls produced at respective floors, while a black dot marked on a passage of each elevator car at various floors indicate the next destination of each elevator car.

Thus, the elevator car No. 1, on which less than a full number of passengers are aboard, is stopping at that moment at the fifth floor in response to the hall call produced at that floor, and is destined to the first floor next, as a passage between the fifth floor and the first floor is designated as an express zone in this building. Consequently, the elevator car No. 1 will reach the first floor with less than a full number of passengers aboard.

Meanwhile, the elevator car No. 2 is descending to the first floor with a full number of passengers aboard, while the elevator car No. 3 is ascending from the first floor to the fourth floor to which the car call has been made.

In this situation, all the hall calls produced at the sixth, ninth, and tenth floors are allocated to the elevator car No. 3, and yet it takes a considerable amount of time for this elevator car No. 3 to serve all these floors, so that the quality of service with respect to the many users waiting on the sixth, ninth, and tenth floors is very low.

Here, in order to improve the transport efficiency, there is an idea to change the allocation of the elevator car No. 3 with respect to the sixth floor to the elevator car No. 1 while the elevator car No. 1 was still located above the sixth floor level, so that the elevator car No. 1 serves the users at the sixth floor fitst, and then stops at the fifth floor to serve the users at the fifth floor, before descending to the first floor.

However, if such a change of allocation is performed, there appears a possibility that the elevator car No. 1 becomes full at the sixth floor, so that it has to pass by the fifth floor despite of the hall call allocation. In such a situation, the priority rights of the users at the fifth floor to whom the elevator car No. 1 had been allocated before the hall call was produced at the sixth floor are unjustly neglected. Thus, even if the transport efficiency can be improved by this method, the overall quality of service has to be severely lowered, and for this reason it is practically impossible to adapt such a method.

SUMMARY OF THE INVENTION

It is therefore an object of the present invention to provide a method and an apparatus for elevator group control, capable of improving the transport efficiency without severely lowering the overall quality of service, even when the traffic demand to a particular floor sharply increased in a particular period of time.

According to one aspect of the present invention there is provided an elevator group control apparatus for controlling an elevator system including a plurality of elevator cars and a plurality of floors, comprising: group control means for performing a hall call allocation control to determine a response elevator car to respond to a hall call produced at one of the floors among the elevator cars of the elevator system, the response elevator car being one of the elevator cars whose allocation results in a highest transport efficiency in the elevator system; and elevator car control means for controlling the elevator cars of the elevator system according to the hall call allocation control, such that in a case the response elevator car having an ultimate destination floor is additionally allocated to another floor which is located in an opposite direction from an ultimate destination of the response elevator car, the responds elevator car is controlled to reverse a direction of motion to serve said another floor and then to reverse the direction of motion again to move to the ultimate destination floor.

According to another aspect of the present invention there is provided a method of elevator group control for controlling an elevator system including a plurality of elevator cars and a plurality of floors, comprising the steps of: performing a hall call allocation control to select a response elevator car to respond to a hall call produced at one of the floors among the elevator cars of the elevator system, the response elevator car being one of the elevator cars whose allocation results in a highest transport efficiency in the elevator system; and controlling the elevator cars of the elevator system according to the hall call allocation control, such that in a case the response elevator car having an ultimate destination floor is additionally allocated to another floor which is located in an opposite direction from an ultimate destination of the response elevator car, the responds elevator car is controlled to reverse a direction of motion to serve said another floor and then to reverse the direction of motion again to move to the ultimate destination floor.

Other features and advantages of the present invention will become apparent from the following description taken in conjunction with the accompanying drawings.

DETAILED DESCRIPTION OF THE PREFERRED EMBODIMENTS

Figure 3:
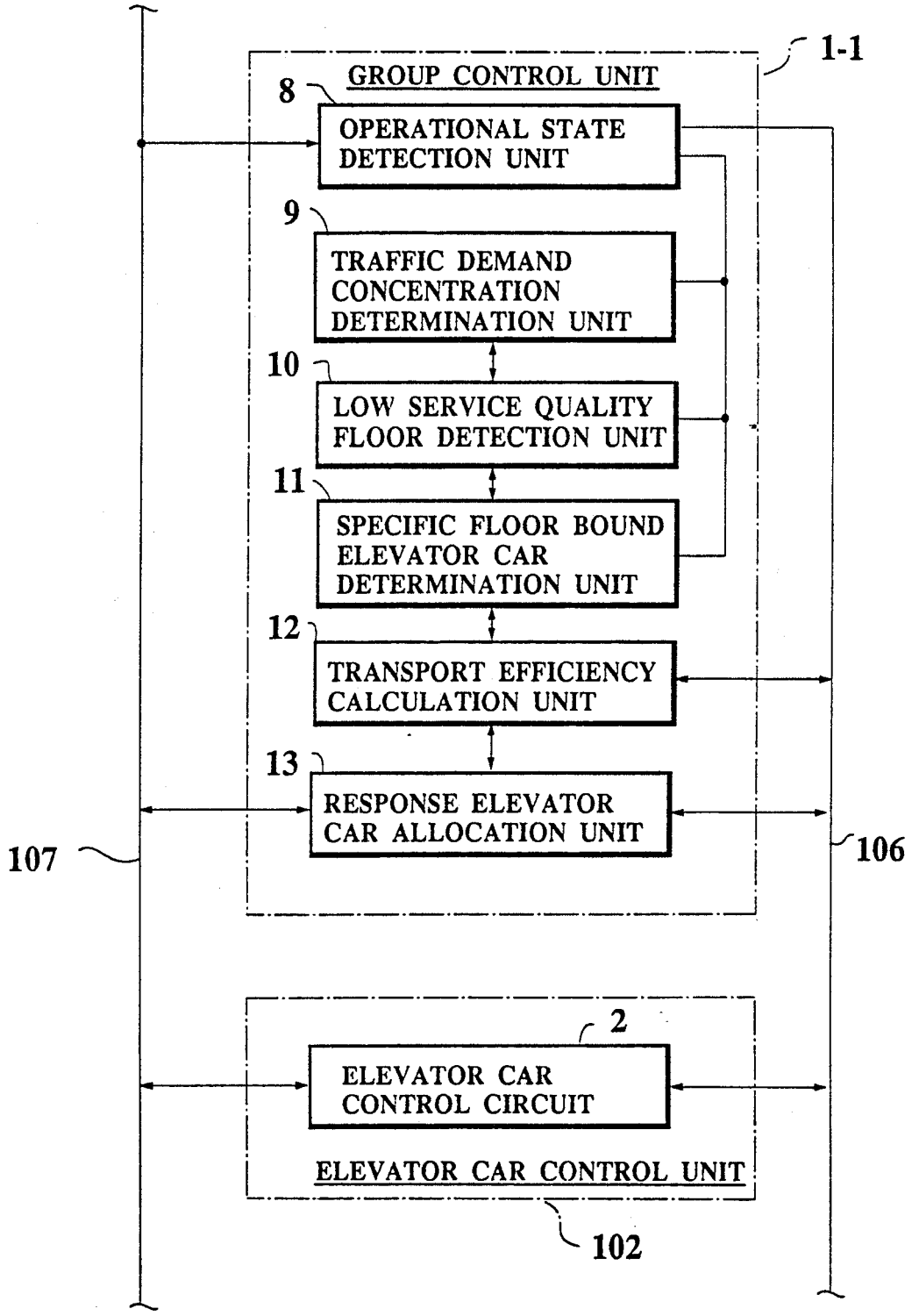
FIG. 3 is a block diagram of a group control unit an an elevator car control unit of a first embodiment of an elevator group control apparatus according to the present invention.

Referring now to FIG. 3, one embodiment of an elevator group control apparatus according to the present invention will be described.

Figure 1:
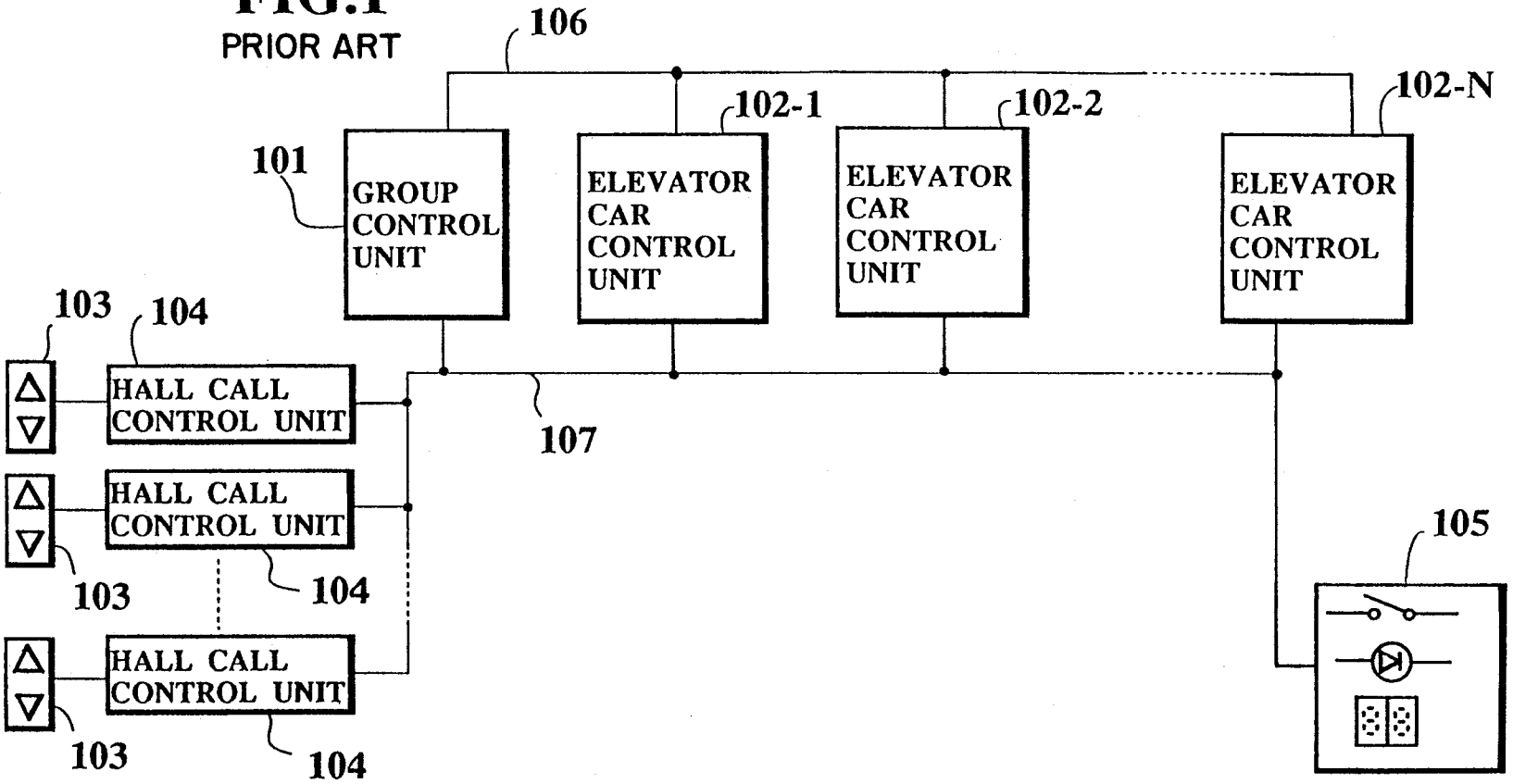
FIG.1 PRIOR ART
FIG. 1 is a schematic block diagram of a conventional elevator group control apparatus.
Figure 2:
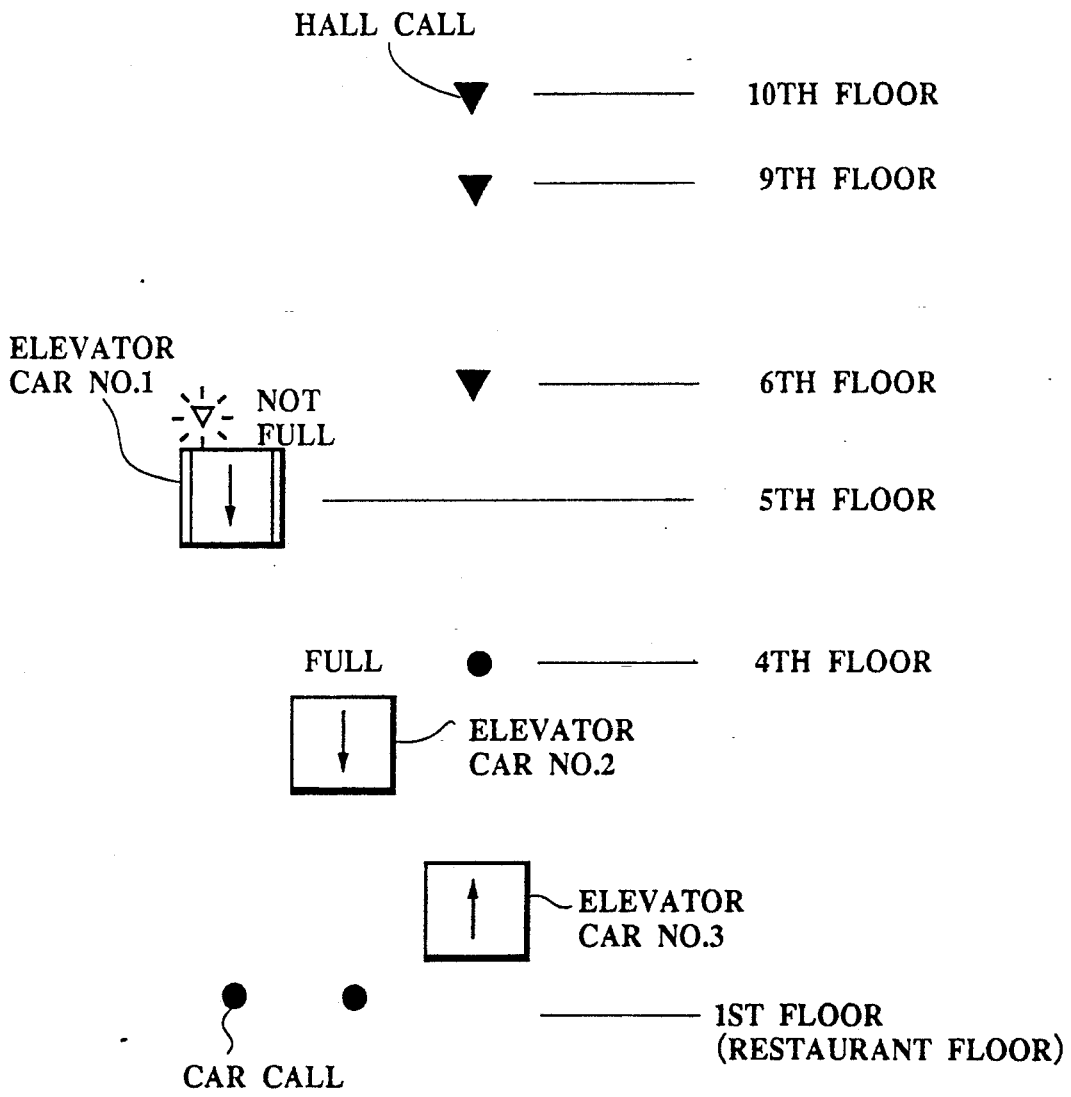
FIG.2 PRIOR ART
FIG. 2 is a diagrammatic illustration of an elevator system for explaining a problem in a conventional elevator group control apparatus.

In this embodiment, the elevator group control apparatus has an overall configuration similar to that shown in FIG. 1 above, i.e., that which comprises: a group control unit 1-1 and a plurality (N in number) of elevator car control units 102-1 to 102-N provided in correspondence with N elevator cars incorporated in an elevator system, where the group control unit 1-1 and the elevator car control units 102-1 to 102-N are connected through a high speed data transmission line 106; hall call buttons 103 provided on each floor of a building in which the elevator system operates; hall call control units 104 provided for each hall call buttons 103 at each floor; and a monitor unit 105, where the hall call control units 104 and the monitor unit 105 are connected with the group control unit 1-1 and elevator car control units 102-1 to 102-N through a low speed data transmission line 107.

Here, in this embodiment, the group control unit 1-1 is different from a conventional one, while the other elements are substantially similar to the corresponding elements of a conventional elevator group control apparatus.

As shown in FIG. 3, the group control unit 1-1 in this embodiment comprises: an operational state detection unit 8 connected to the high speed data transmission line 106 and the low speed data transmission line 107, a traffic demand concentration determination unit 9, a low service quality floor determination unit 10, a specific floor bound elevator car determination unit 11, a transport efficiency calculation unit 12 connected to the high speed data transmission line 106, and a response elevator car allocation unit 13 connected to the high speed data transmission line 106 and the low speed data transmission line 107.

The operational state detection unit 8 receives data on an operational state of each elevator car such as a current car call registration, from an elevator car control circuit 2 of each of the elevator car control units 102-1 to 102-N, and produces detection signals which are given to the traffic demand concentration determination unit 9, the low service quality floor determination unit 10, and the specific floor bound elevator car determination unit 11.

Now, the operation of this elevator group control apparatus and the resulting operation of the elevator system will be described.

Figure 4:
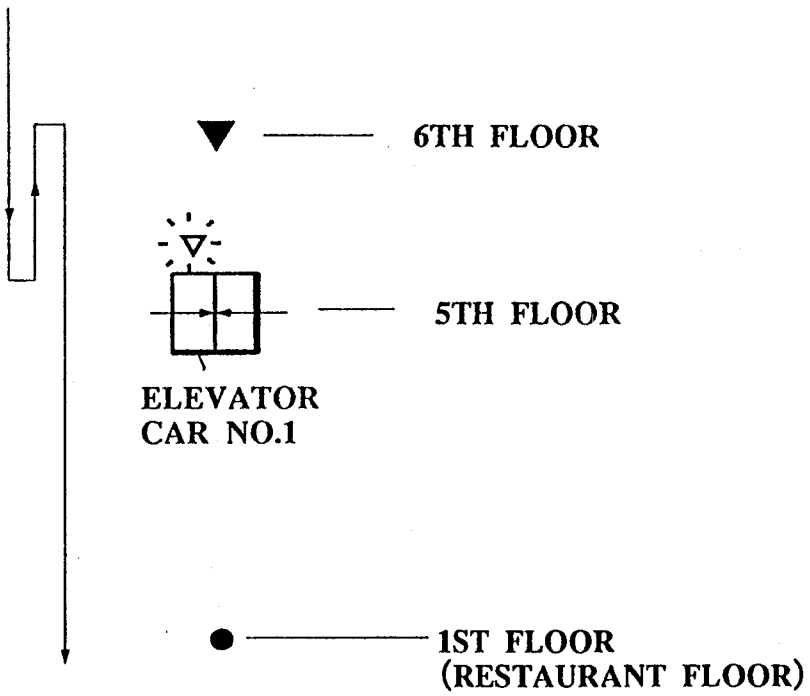
FIGS. 4(A) and (B) are diagrammatic illustrations of an elevator system controlled by the group control unit of FIG. 3 for explaining its operation.
Figure 4:
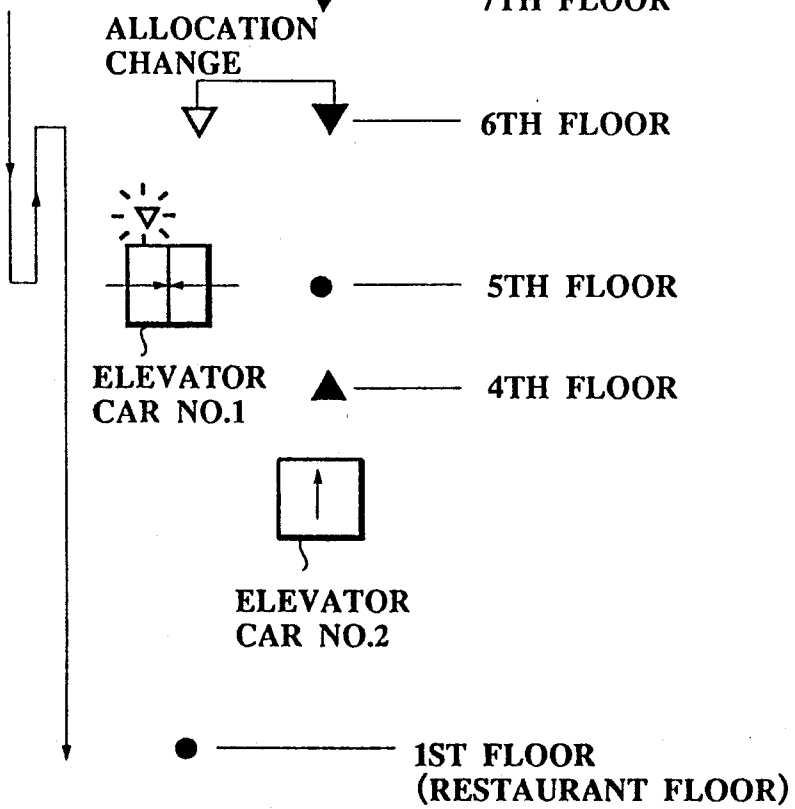

In short, the elevator group control by this elevator group control apparatus is characterized in that, as shown in FIG. 4(A), when one elevator car (elevator car No. 1) stopping at the fifth floor is not full and is bound to a specific floor (the first floor) to which the traffic demands are concentrating, in response to a hall call produced at the sixth floor, a usual allocation of the other elevator car (elevator car No. 2) which is expected to take a longer time before serving the sixth floor is cnanged to this elevator car (elevator car No. 1), such that this elevator car (elevator car No. 1) serves the sixth floor after the fifth floor by reversing its direction before moving to the ultimate destination (first floor), in order to improve the transport efficiency. Also, as shown in FIG. 4(B), even when the allocation determined in a usual manner is this elevator car (elevator car No. 1) itself, this elevator car (elevator car No. 1) is controlled similarly, such that this elevator car (elevator car No. 1) serves the sixth floor after the fifth floor by reversing its direction before moving to the ultimate destination (first floor), in order to improve the transport efficiency.

Such an elevator group control is achieved in this embodiment by the operation of the group control unit 1-1 which is carried out according to the flow charts of FIGS. 5*a* and 5*b*, as follows.

First, at the step 51, the operational state detection unit 8 receives data on an operational state of each elevator car such as a current car call registration, from an elevator car control circuit 2 of each of the elevator car control units 102-1 to 102-N, in order to detect the traffic demand.

Then, at the step 52, according to the detection made by the operational state detection unit 8, the traffic demand concentration determination unit 9 determines whether the elevator system is in a situation in which the traffic demand is concentrated to a particular floor by an extent greater than a prescribed threshold level, or not. This determination can be made on a basis of a condition that a number of the hall calls whose direction is directed toward the particular floor plus a number of car calls which specifies the particular floor as a desired destination is greater than a prescribed threshold, and at the same time a weight given to this particular floor which indicates how likely a passenger is to get off at this floor is over 70%, for example.

If the elevator system is not found to be a traffic demand concentrated state, the process terminates, whereas when the elevator system is found to be in a traffic demand concentrated state, then the following steps 54 tp 58 are performed for each elevator car of the elevator system by the steps 53 and 59. Here, at the step 53, C is a number labelling each elevator car, which goes from O to CMAX. Thus, when there are eight elevator cars in the elevator system, C goes from 0 to 7.

At the step 54, the low service quality floor determination unit 10 determines a floor (referred hereafter as an fp floor) for which the quality of service is lowered such that the response time is longer than a prescribed threshold time, while a door of this elevator car is open. The response time can be longer than a prescribed threshold time in the following four circumstances:

(1) the elevator car allocated to the fp floor has passed the fp floor, because it was already full.

(2) the estimated response time is longer than the prescribed threshold time.

(3) call continuation time is longer than the prescribed threshold time.

(4) the estimated response time become longer since the time at which the original allocation was made.

When such an fp floor is found to be existing at the step 54, next at the step 55, the specific floor bound elevator car determination unit 11 determines whether the next car call of each elevator is the particular floor such that this elevator is to move to the particular floor next or not, as well as whether this elevator car has already passes the fp floor or not.

When this elevator car is found to have already passed the fp floor at the step 55, next at the step 56, the transport efficiency calculation unit 12 calculates a distance from a current position of this elevator car to the fp floor, and determines whether this distance is less than a prescribed threshold distance.

When this distance is found to be less than the prescribed threshold distance at the step 56, next at the step 57, the transport efficiency calculation unit 12 also calculates a distance from a current position of this elevator car to the particular floor, and determines whether this distance is greater than a prescribed threshold distance.

When this distance is found to be greater than the prescribed threshold distance at the step 57, next at the step 58, the response elevator car allocation unit 13 sends a priority allocation command signal to the elevator car control circuit 2 of the elevator car control unit 102 corresponding to this elevator, such that this elevator is allocated to the fp floor.

When these steps 54 to 58 are performed for every elevator car of the elevator system, next the response elevator car allocation unit 13 performs the following steps 61 to 64 for each elevator car of the elevator system at a timing of a departure of each elevator car i.e., a closing of a door of each elevator car, by the steps 60 and 65.

At the step 61, the response elevator car allocation unit 13 confirms a response from the elevator car control circuit 2 to which the priority allocation command signal has been sent, and at the step 62, it determines whether this response indicates the allocation specified by the priority allocation command signal is accepted or rejected.

When this response is the one that indicates the acceptance, next at the step 63, the response elevator car allocation unit 13 sends an allocation change command signal to the hall call control unit 104 associated with the fp floor. In response to this allocation change command signal, the hall call control unit 104 changes the indication of the allocation indication lamps located in a vicinity of the hall entrances of the elevator cars, i.e., the one for the previously allocated elevator car is turned off while the one for the newly allocated elevator car is turned on, so that the user waiting for the arrival of the elevator car at the hall way of the fp floor can recognize the change of allocation, i.e., which one of the elevator cars is coming.

On the other hand, when this response is the one that indicates the rejection, next at the step 64, the response elevator car allocation unit 13 cancels the priority allocation command signal sent to the elevator car control circuit 2.

Now, in response to the operation of the group control unit 1-1 as described above, the elevator car control circuit 2 is controlled to perform the following operation to be carried out according to the flow chart of FIG. 6, as follows.

First, at the step 66, whether each elevator car is at a timing of a departure or not is determined, If not, the process terminates so that this elevator car is operated in a normal manner, whereas otherwise next at the step 67, whether there is a priority allocation command signal given by the response elevator car allocation unit 13 of the group control unit 1-1 to each elevator car control circuit 2 is determined. If not, the process terminates so that this elevator car is operated in a normal manner, whereas otherwise next at the step 68, whether a car weight of each elevator car is over a prescribed threshold value or not is determined in order to judge whether this elevator car has a sufficient capacity to carry the waiting users. Here, the car weight is a total weight of the passengers aboard the elevator car which is detected by means of a weight sensor incorporated in a floor of each elevator car. The car weight so determined can effectively give an estimate for a number of passengers aboard the elevator car. The prescribed threshold value may be set to 70% of a maximum loading capacity of the elevator car, for example.

When the car weight is over the prescribed threshold value at the step 68, the elevator car control circuit 2 sends a priority allocation acceptance response signal to the response elevator car allocation unit 13 of the group control unit 1-1 at the step 69, whereas otherwise the elevator car control circuit 2 sends a priority allocation rejection response signal to the response elevator car allocation unit 13 of the group control unit 1-1 at the step 70 and the process terminates so that this elevator car is operated in a normal manner.

When the priority allocation is accepted at the step 69, next at the step 71, the elevator car control circuit 2 reverses a direction of motion of the corresponding elevator car, so that a direction of the fp floor is selected for this elevator car. Then, when this elevator car has reached the fp floor at the step 72, the elevator car control circuit 2 cancel the previous selection of the direction of motion toward the fp floor at the step 73 to reverse a direction of motion of the corresponding elevator car again, so that a direction of the particular floor is now selected for this elevator car. Then at the step 74, a normal manner of operation is resumed for this elevator car. Thus, when this elevator moves to the fp floor to serve the users waiting at the fp floor, and then resumes its original motion toward the particular floor.

As described according to this embodiment, it is possible to improve the transport efficiency without severely lowering the overall quality of service, even when the traffic demand to a particular floor sharply increased in a particular period of time. Namely, by the controlling of the group contol unit 1-1 as described above, the elevator cars of the elevator system is controlled such that while each elevator car is moving to the particular floor, the intervening floors from which the hall calls are produced and to which this elevator car has been allocated are not passed by for the reason that this elevator car is full, and yet by the time this elevator car reaches to the particular floor, this elevator car is at least nearly full.

Figure 7:
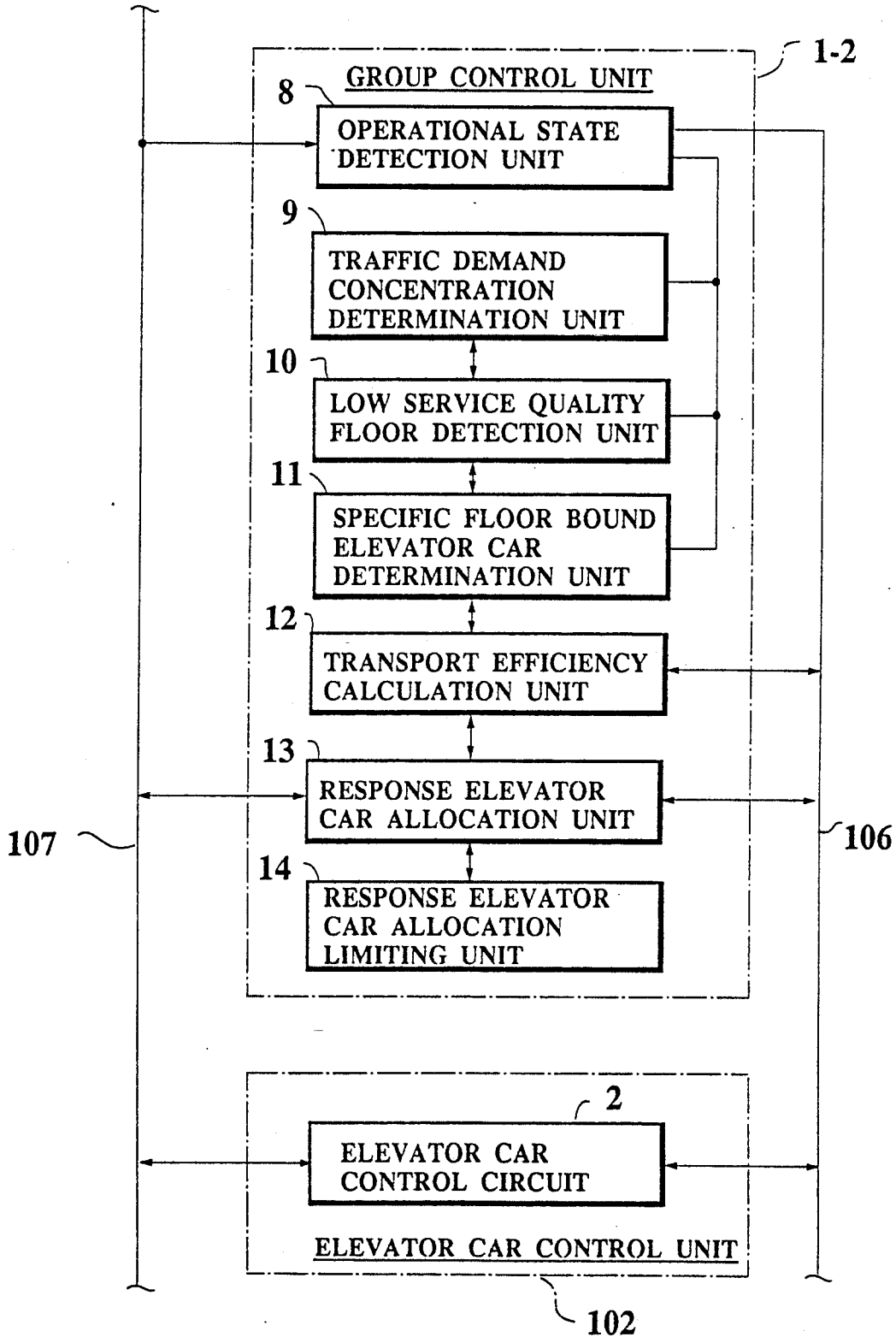
FIG. 7 is a block diagram of a group control unit an an elevator car control unit of a second embodiment of an elevator group control apparatus according to the present invention.

Referring now to FIG. 7, a second embodiment of an elevator group control apparatus according to the present invention will be described. In the following description, those elements which are substantially equivalent to the corresponding elements appeared in the first embodiment will be given the same labels and reference numerals in the figures, and their descriptions are omitted.

In this embodiment, the elevator group control apparatus has an overall configuration similar to that shown in FIG. 1 above, as in the first embodiment above, while the group control unit 1-2 of this embodiment differs from the group control unit 1-1 of the first embodiment above in having an additional element of a response elevator car allocation limiting unit 14, which is connected with the response elevator car allocation unit 13, as can be seen in FIG. 7.

This response elevator car allocation limiting unit 14 limits the number of priority allocation commands given by the response elevator car allocation unit 13 at any time below a prescribed threshold number by cancelling any further priority allocation command.

Such a response elevator car allocation limiting unit 14 is incorporated in this embodiment because, when the number of priority allocation commands are unlimited as in the first embodiment above, there is a possibility that a plurality of the elevator cars of the elevator system are simultaneously operated by these priority allocation commands, according to which these elevator cars have to go through the reversing of the direction of motion, such that the waiting at the other floors with respect to which the priority allocation is not given may become unfairly longer, such that quality of service with respect to the other floors may be lowered considerably. The limitation of the number of priority allocation commands given by the response elevator car allocation unit 13 at any time by the response elevator car allocation limiting unit 14 of this embodiment can effectively prevent the occurrence of such a situation.

In accordance with the addition of the response elevator car allocation limiting unit 14, the operation of the group control unit 1-2 which is to be carried out according to the flow charts of FIGS. 8*a*, and 8*b* differs from the operation of the group control unit 1-1 of the first embodiment above in having an additional step 57*a* of determining whether a current number of the elevator cars operated by the priority allocation commands is below the prescribed threshold number, between the steps 57 and 58. The sending of a priority allocation command signal by the response elevator car allocation unit 13 to the elevator car control circuit 2 of the elevator car control unit 102 takes place only when the current number of the elevator cars operated by the priority allocation commands is found to be below the prescribed threshold number at the step 57*a*.

Figures 5, 5A:
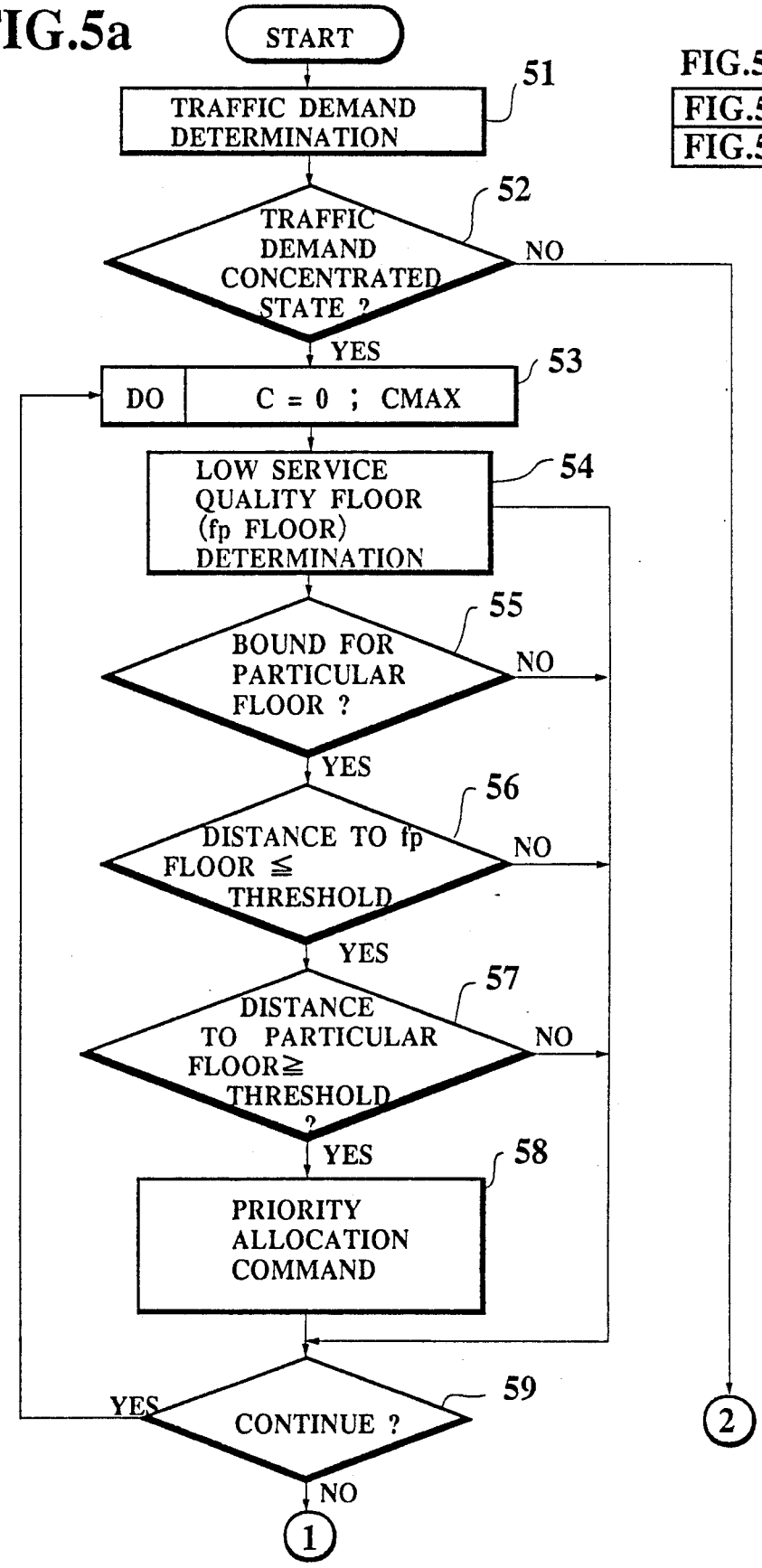
FIGS. 5*a* and 5*b* are flow charts for the operation of the group control unit of FIG. 3.
Figure 5B:
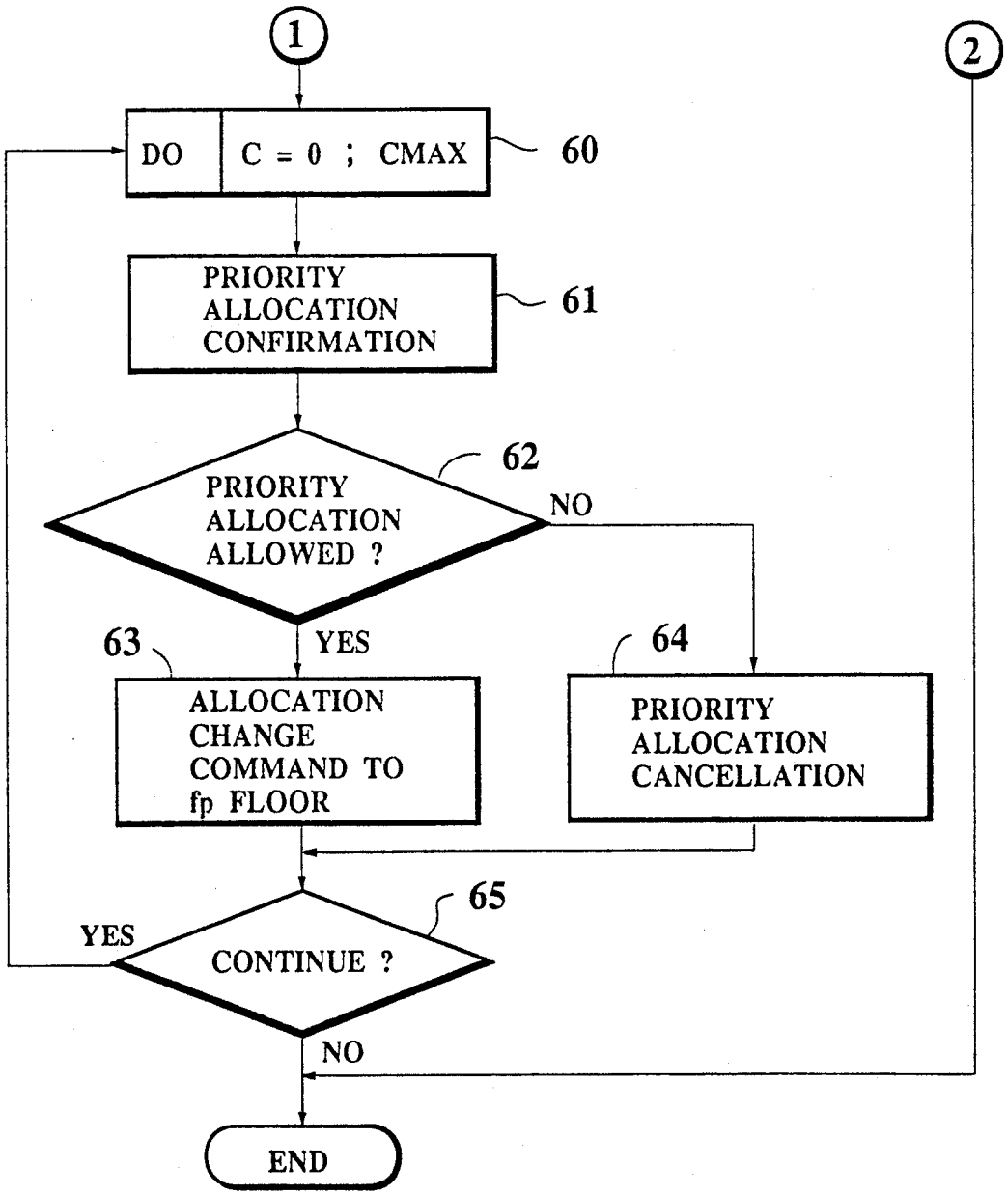
Figure 8A:
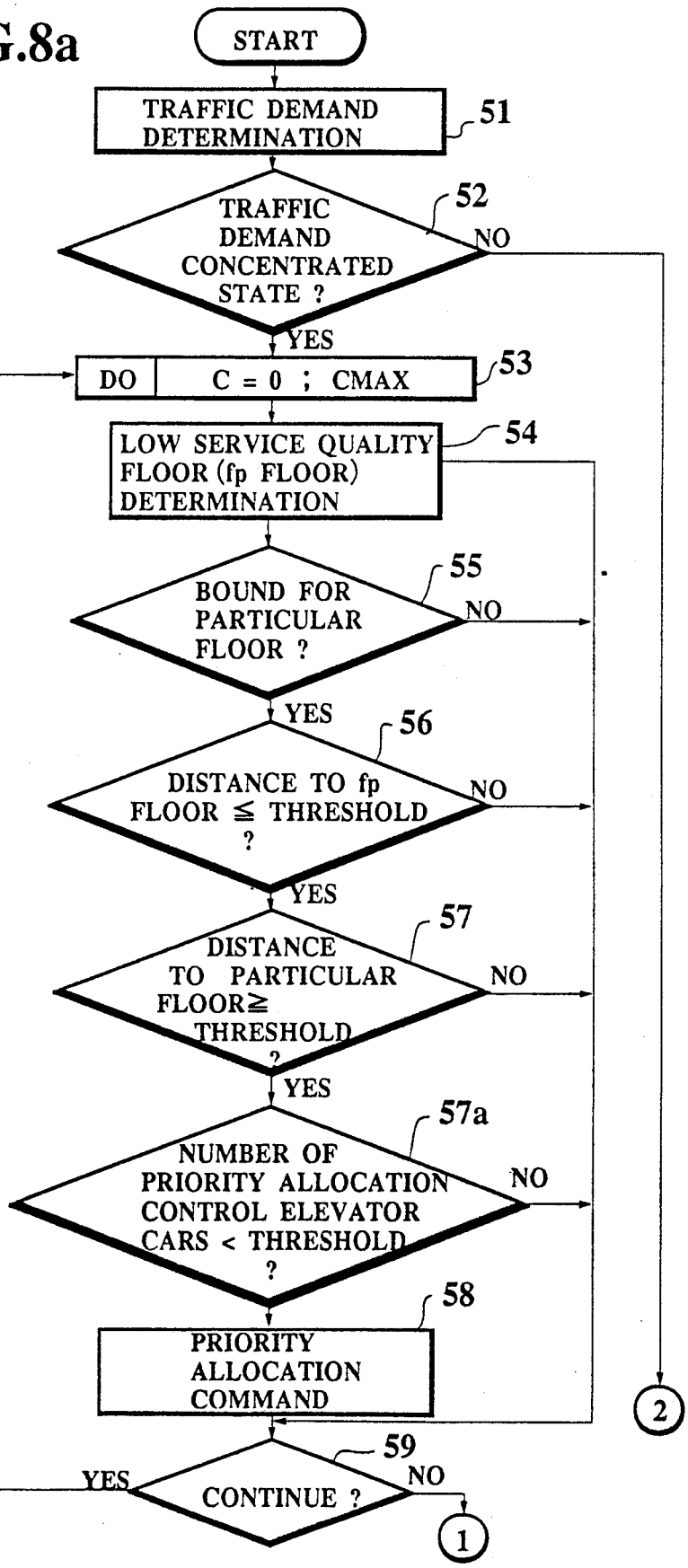
FIGS. 8*a* and 8*b* are flow charts for the operation of the group control unit of FIG. 7.
Figure 8B:
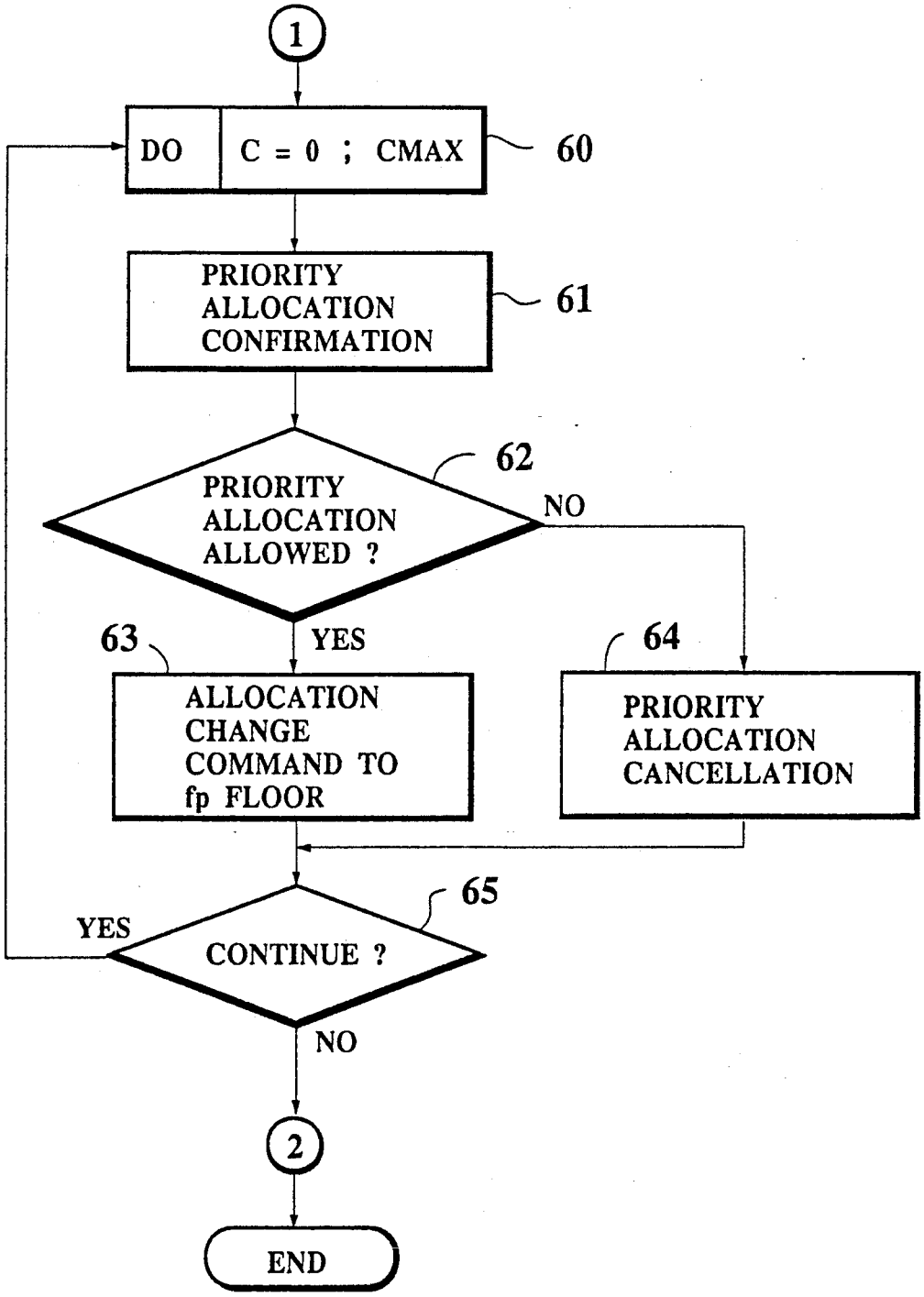

The other steps in FIGS. 8*a* and 8*b* are substantially equivalent to those appearing in FIGS. 5*a* and 5*b* for the first embodiment above.

Figure 6:
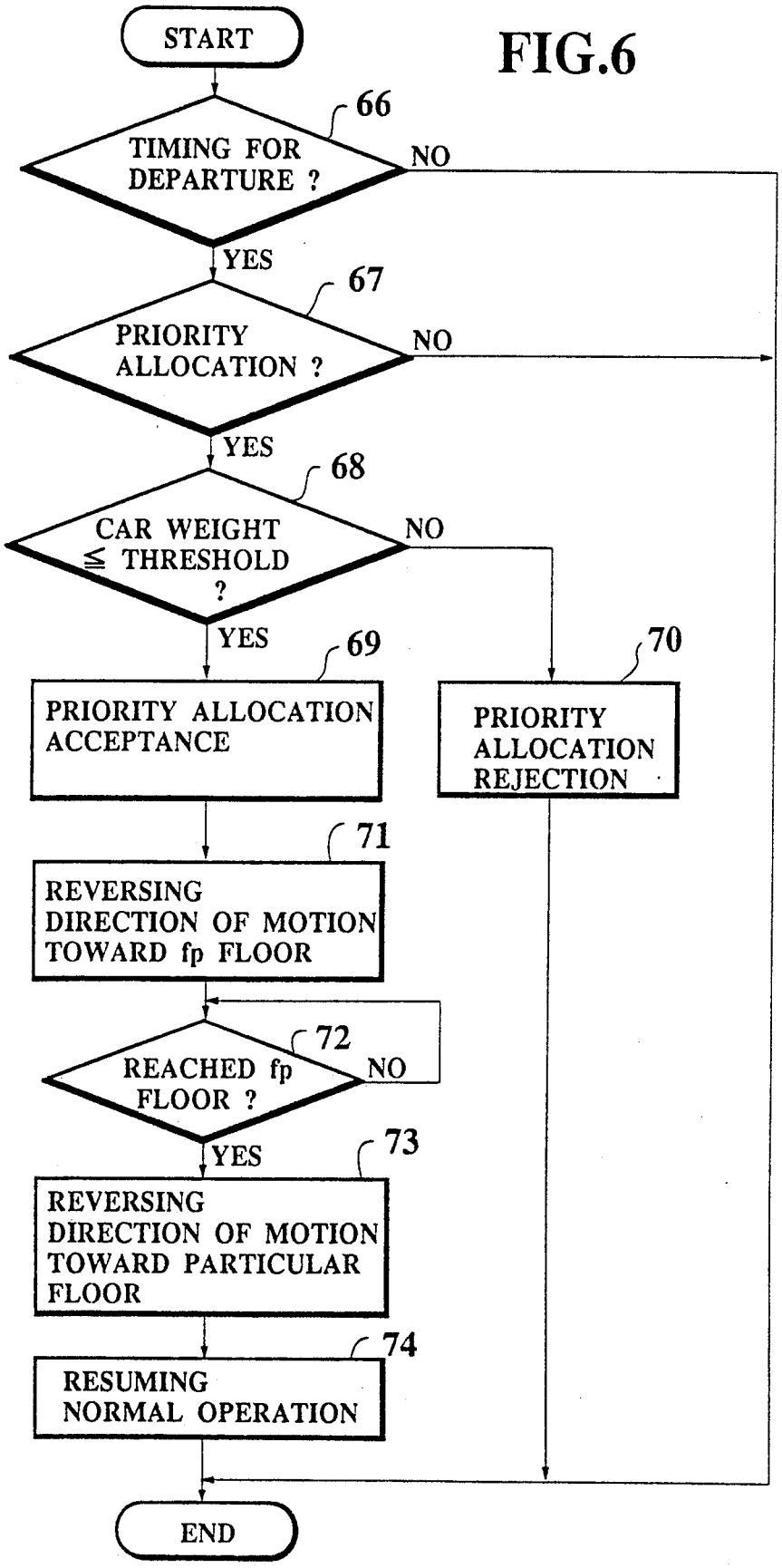
FIG. 6 is a flow chart for the operation of the elevator car control unit of FIG. 3.

Also, the operation of the elevator car control circuit 2 shown in FIG. 6 for the first embodiment is unchanged for this embodiment.

It should be obvious that this second embodiment can achieve the same effects as those described above for the first embodiment, and furthermore a further possibility of a lowering of the quality of service in the elevator system is prevented as already mentioned.

Figure 9:
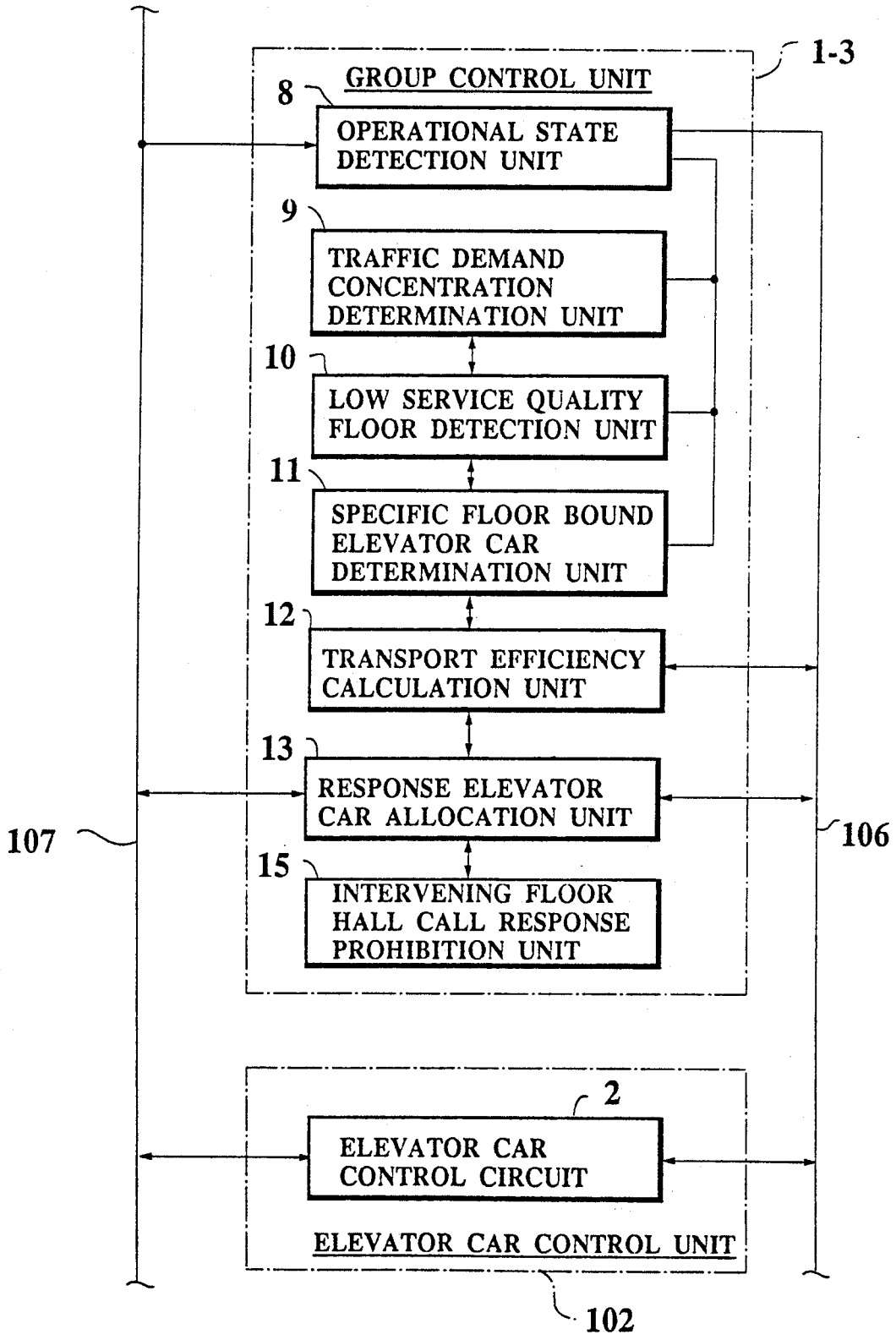
FIG. 9 is a block diagram of a group control unit an an elevator car control unit of a third embodiment of an elevator group control apparatus according to the present invention.

Referring now to FIG. 9, a third embodiment of an elevator group control apparatus according to the present invention will be described. In the following description, those elements which are substantially equivalent to the corresponding elements appeared in the first embodiment will be given the same labels and reference numerals in the figures, and their descriptions are omitted.

In this embodiment, the elevator group control apparatus has an overall configuration similar to that shown in FIG. 1 above, as in the first embodiment above, while the group control unit 1-3 of this embodiment differs from the group control unit 1-1 of the first embodiment above in having an additional element of an intervening floor hall call response prohibition unit 15, which is connected with the high speed data transmission line 106, and low speed data transmission line 107, as can be seen in FIG. 9.

This intervening floor hall call response prohibition unit 15 prohibits the elevator car operated by the priority allocation command from responding to any hall call while this elevator car is moving to the fp floor by reversing the direction of motion.

Such an intervening floor hall call response prohibition unit 15 is incorporated in this embodiment because, without a such prohibition, there is a possibility that the elevator car which is operated by the priority allocation command and which is moving from a starting floor (referred to hereafter as an fc floor) to the fp floor by reversing the direction of motion may respond to a hall call produced at a floor between the fc floor and fp floor. If such a case happens, while those passenger already aboard this elevator would be confused because they believe they are on an elevator car going toward the particular floor, while in responding to the intervening floor hall call, the elevator have to indicate to the users at that intervening floor that it is going to the opposite direction. On the other hand, the passengers entered from that intervening floor believing that they are on an elevator car going in that opposite direction would be surprised when the elevator reversed the direction of motion at the fp floor. The prohibition of the elevator car operated by the priority allocation command from responding to any further hall call while this elevator car is moving to the fp floor by reversing the direction of its motion by the intervening floor hall call response prohibition unit 15 of this embodiment can effectively prevent the occurrence of such a situation.

Figures 10, 10A:
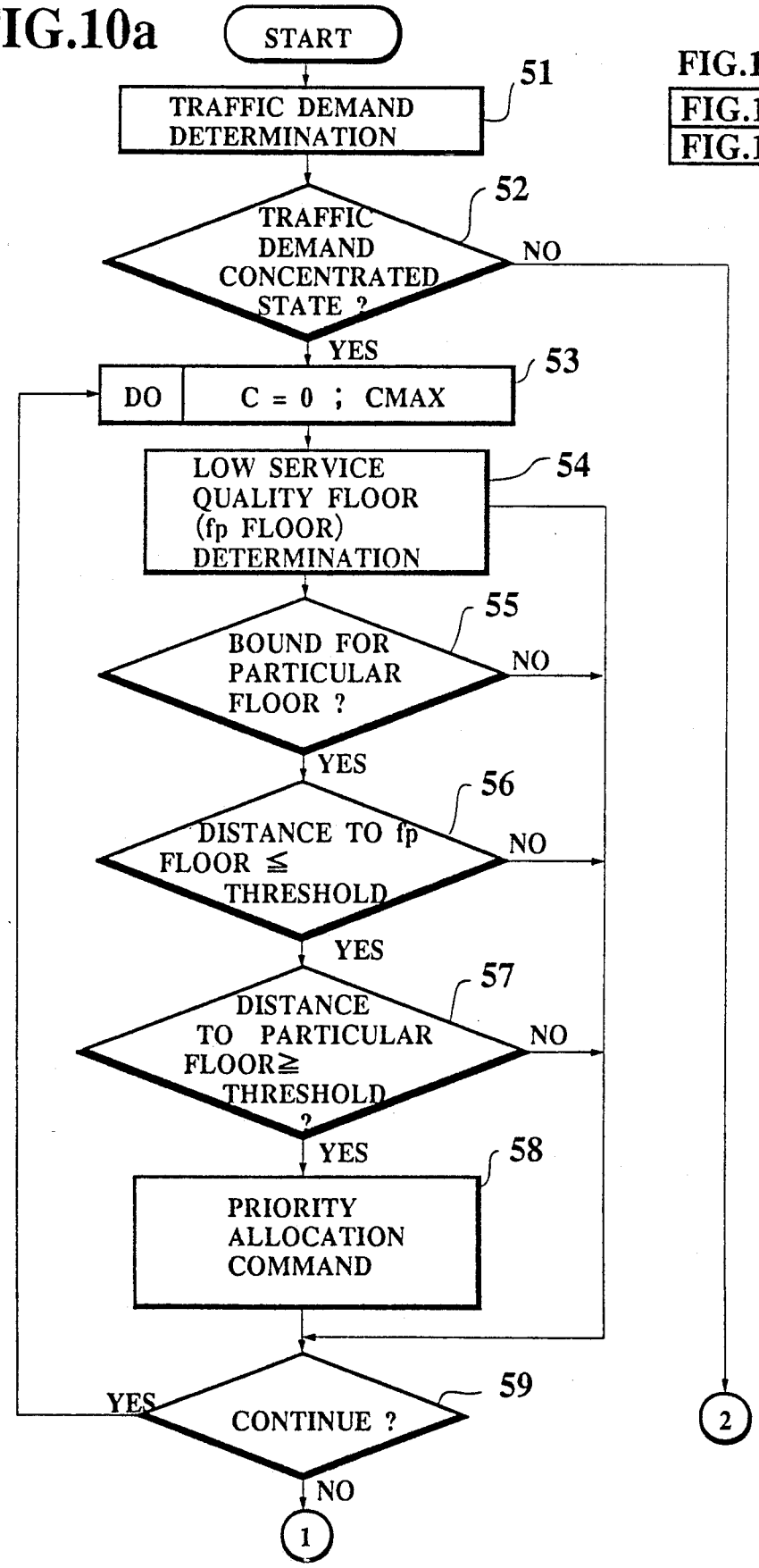
FIGS. 10*a* and 10*b* are flow charts for the operation of the group control unit of FIG. 9.
Figure 10B:
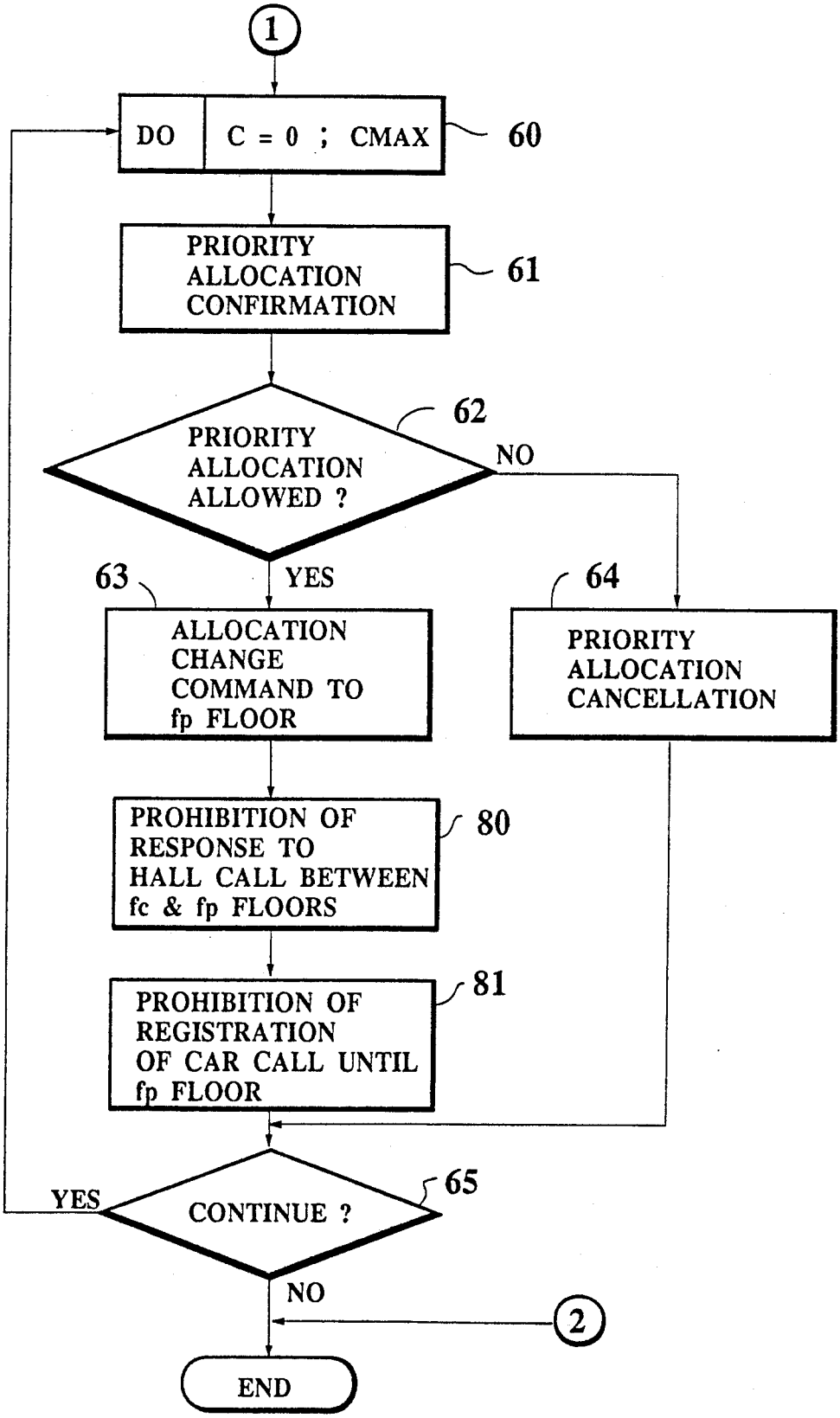

In accordance with the addition of the intervening floor hall call response prohibition unit 15, the operation of the group control unit 1-3 which is to be carried out according to the flow chart of FIGS. 10*a* and 10*b* differs from the operation of the group control unit 1-1 of the first embodiment above in having additional steps 80 and 81 between the steps 63 and 65, where at the step 80, the elevator car operated by the priority allocation command is prohibited to respond to any hall call while moving from the fc floor to the fp floor by reversing the direction of motion, and at the step 81, this elevator car is prohibited to register any car call until it reaches to the fp floor.

The other steps in FIGS. 10*a* and 10*b* are substantially equivalent to those appearing in FIGS. 5*a* and 5*b* for the first embodiment above.

Figure 11:
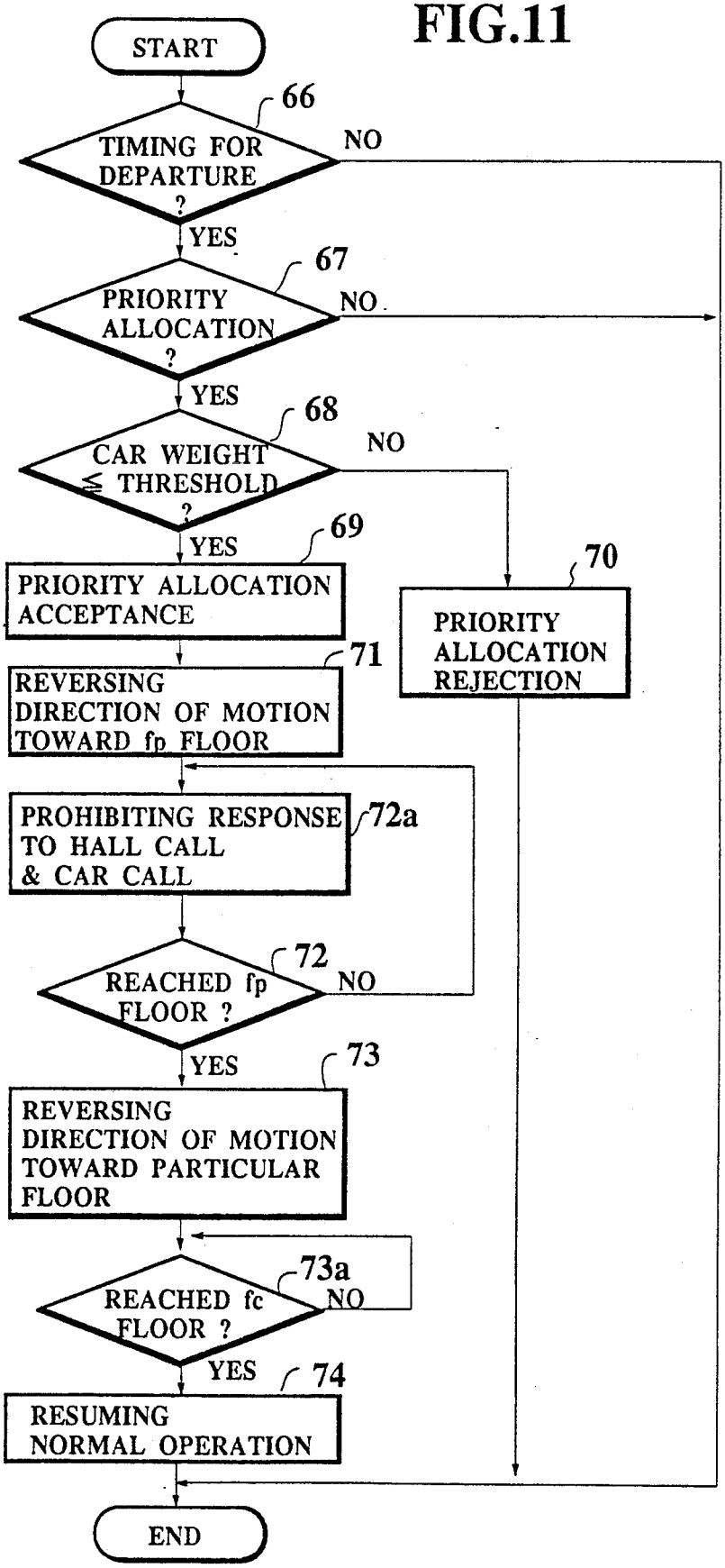
FIG. 11 is a flow chart for the operation of the elevator car control unit of FIG. 9.

Also, in accordance with the above described operation of the group control unit 1-3, the operation of the elevator car control circuit 2 which is to be carried out according to the flow chart of FIG. 11, differs from that in the first embodiment above in having additional steps 72*a* between the steps 71 and 72, and 73*a* between the steps 73 and 74, where at the step 72*a*, the elevator car control circuit 2 controls the elevator car such that this elevator car neither respond to any hall call while moving from the fc floor to the fp floor by reversing the direction of motion, nor register any car call until it reaches to the fp floor, and at the step 73*a*, whether the elevator car reached the fc floor or not is determined, such that the resuming of the normal manner of operation of this elevator car at the step 74 does not take place before the elevator car returns to the starting position at the fc floor.

The other steps in FIG. 11 are substantially equivalent to those appearing in FIGS. 5*a* and 5*b* for the first embodiment above.

It should be obvious that this third embodiment can achieve the same effects as those described above for the first embodiment, and furthermore a further possibility of a lowering of the quality of service in the elevator system is prevented as already mentioned.

Figure 12:
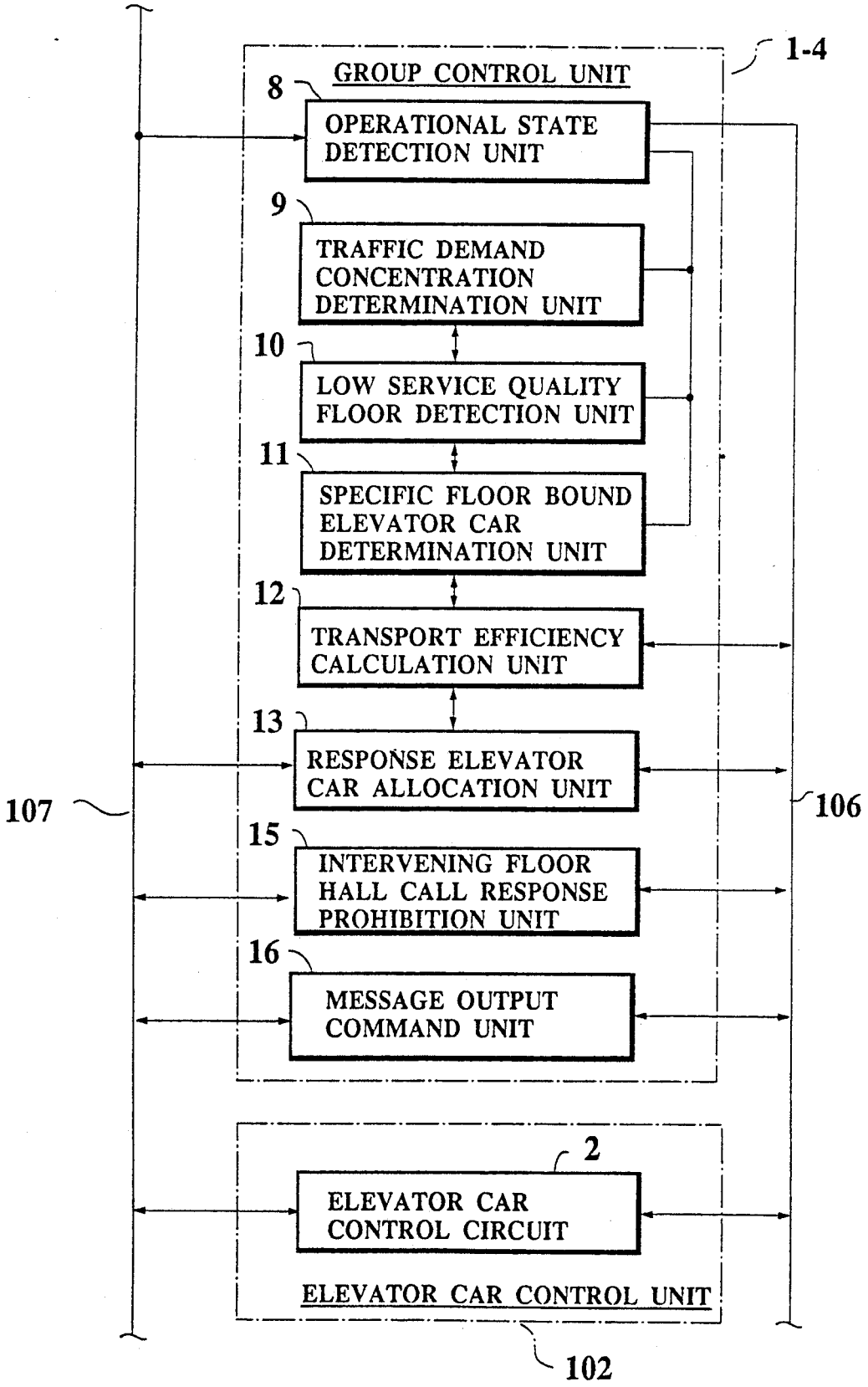
FIG. 12 is a block diagram of a group control unit an an elevator car control unit of a fourth embodiment of an elevator group control apparatus according to the present invention.

Referring now to FIG. 12, a fourth embodiment of an elevator group control apparatus according to the present invention will be described. In the following description, those elements which are substantially equivalent to the corresponding elements appeared in the third embodiment will be given the same labels and reference numerals in the figures, and their descriptions are omitted.

In this embodiment, the elevator group control apparatus has an overall configuration similar to that shown in FIG. 1 above, as in the first embodiment above, while the group control unit 1-4 of this embodiment differs from the group control unit 1-3 of the third embodiment above in having an additional element of a message output command unit 16, which is connected with the high speed data transmission line 106, and low speed data transmission line 107, as can be seen in FIG. 12.

This message output command unit 16 commands the elevator car operated by the priority allocation command to notify the passages inside the elevator car about its operations while this elevator car is moving to the fp floor be reversing the direction of its motion, in a form of a visual message and/or a audio message.

Such a message output command unit 16 is incorporated in this embodiment because, without such a notification, the passengers without a knowledge of the operational mode of this elevator system may be surprised or confused by the unusual motion of the elevator car. The notification by the message output command unit 16 of this embodiment can effectively prevent the occurrence of such a situation.

Figure 13:
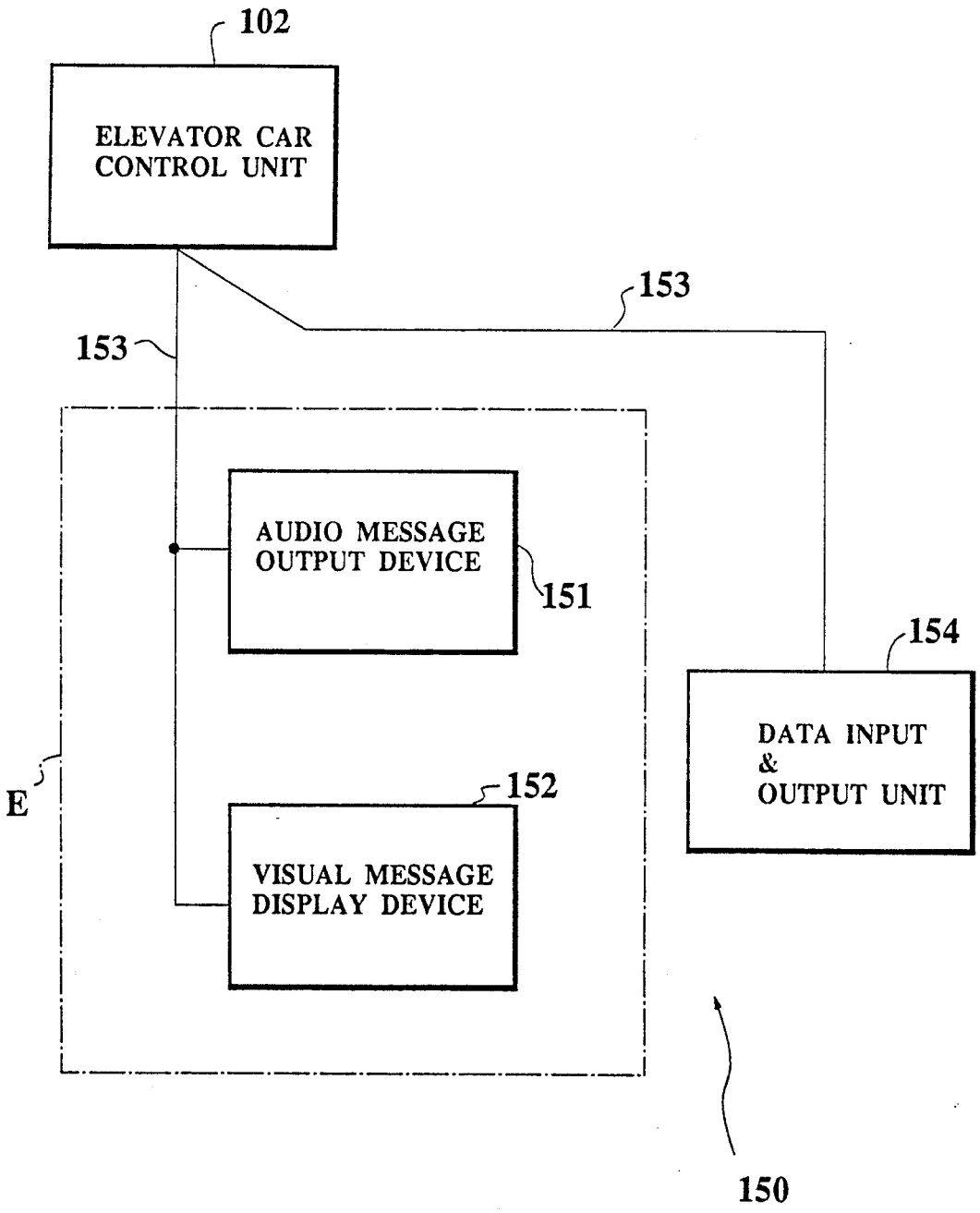
FIG. 13 is a schematic block diagram of a message output device to be incorporated in the elevator system of the fourth embodiment.

In addition, each elevator car of the elevator system of this embodiment is further equipped, as shown in FIG. 13, with a message output device 150 comprising an audio message output device 151 and a visual message display device 152, both of which are located inside the elevator car E and are connected to the elevator car control unit 102 corresponding to this elevator car E through a data transmission line 153, and a data input and output device 154 connected to the elevator car control unit 102 through a data transmission line 153.

Figure 14:
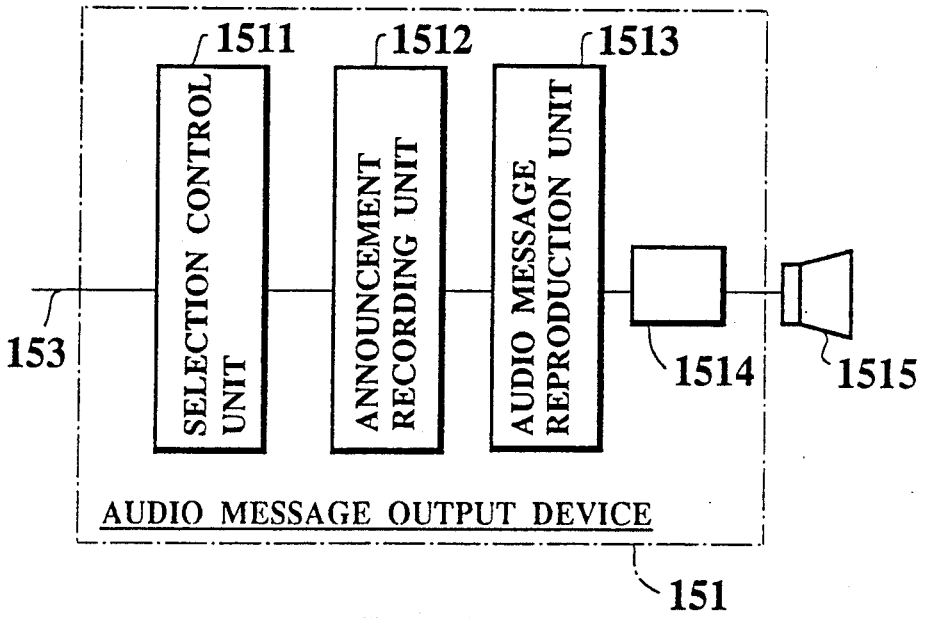
FIG. 14 is a block diagram of an audio message output device of the message output device of FIG. 13.

As shown in FIG. 14, the audio message output device 151 further comprises a selection control unit 1511 for receiving and analyzing signals from the elevator car control unit 102, an annoucement recording unit 1512 for recording several audio messages to be outputted, an audio message reproduction unit 1513 for selectively reproducing one annoucement to be outputted from the announcements recorded in the annoucement recording unit 1512, an audio signal amplifier 1514 for amplifying the annoucement reproduced by the audio message reproduction unit 1513, and a speaker 1515 for outputting the annoucement amplified by the audio signal amplifer 1514. Here, the audio message to be outputted from this audio message output device 151 may be a simple message such as "We will go up for a while", for example.

Figure 15:
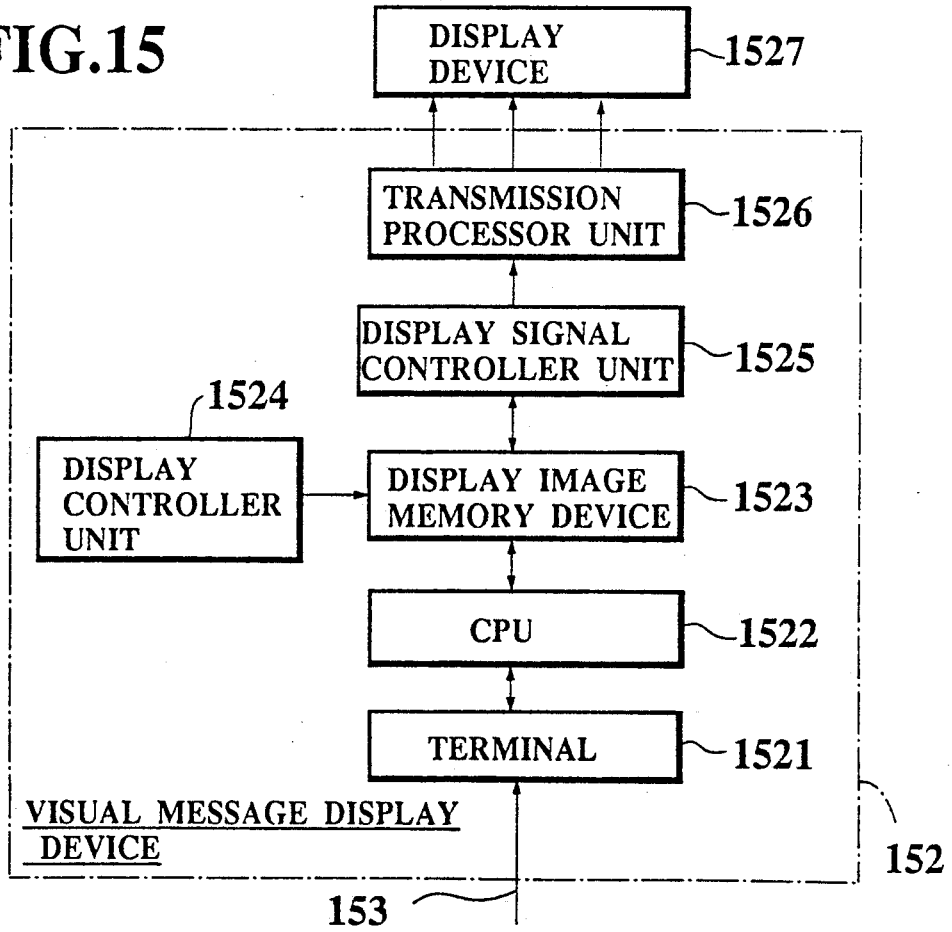
FIG. 15 is a block diagram of a visual message output device of the message output device of FIG. 13.

Also, as shown in FIG. 15, the visual message display device 152 further comprises a terminal 1521 for receiving signals from the elevator car control unit 102, a CPU 1522 for controlling the other elements of the visual message display device 152, a display image memory device 1523 for memorizing the visual messages to be displayed, a display controller unit 1524, a display signal controller unit 1525, a transmission processor unit 1526, and a display device 1527 for actually displaying the visual message. Here, the visual message to be displayed by this visual message display device 152 may be the same message as that outputted by the audio message output device 151 written out.

Thus, when the data regarding various messages to be produced which are stored in the data input and output device 154 in advance are given to the elevator car control unit 102, the elevator car control unit 102 produces the signals to control the audio message output device 151 and the visual message display device 152, such that in the audio message output device 151, the selection control unit 1511 receives an analyzes the signals from the elevator car control unit 102, the annoucement recording unit 1512 selects one of the several recorded audio messages in accordance with the signals analyzed by the selection control unit 1511, and audio message reproduction unit 1513 reproduces the selected annoucement recorded in the annoucement recording unit 1512, the audio signal amplifier 1514 amplifies the annoucement reproduced by the audio message reproduction unit 1513, and the speaker 1515 outputs the annoucement amplified by the audio signal amplifier 1514, while in the visual message display device 152, the terminal 1521 receives the signals from the elevator car control unit 102, the CPU 1522 determines the visual message to be displayed in accordance with these signals and send the determined visual message to the display image memory device 1523, from which the visual message is read out by the display signal controller unit 1525 with the interval and speed of reading controlled by the display controller unit 1524, and the read out visual message is transmitted to the display unit 1527 through the transmission processor unit 1526, so that the visual message is actually displayed on the display device 1527.

Figures 16, 16A:
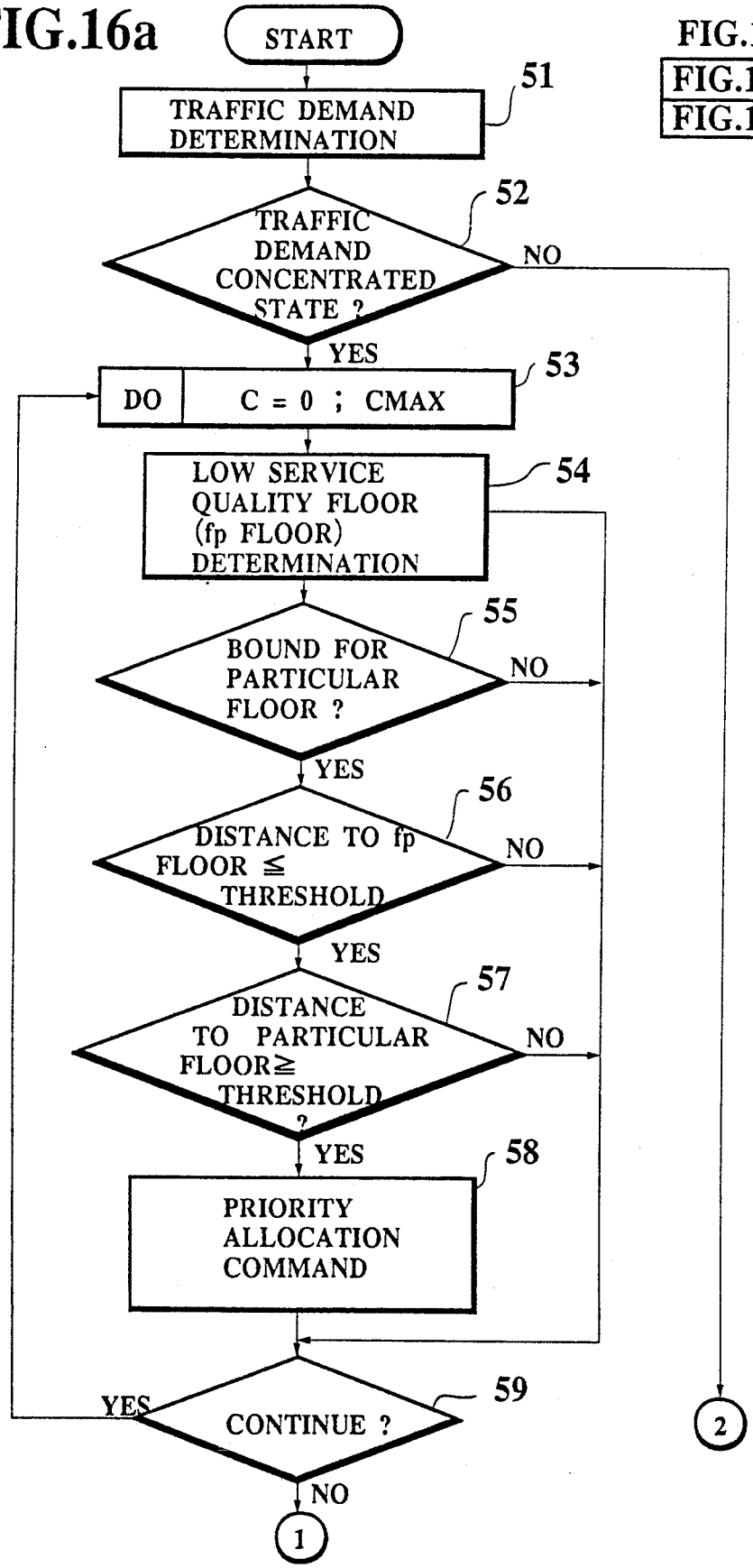
FIGS. 16*a* and 16*b* are flow charts for the operation of the group control unit of FIG. 12.
Figure 16B:
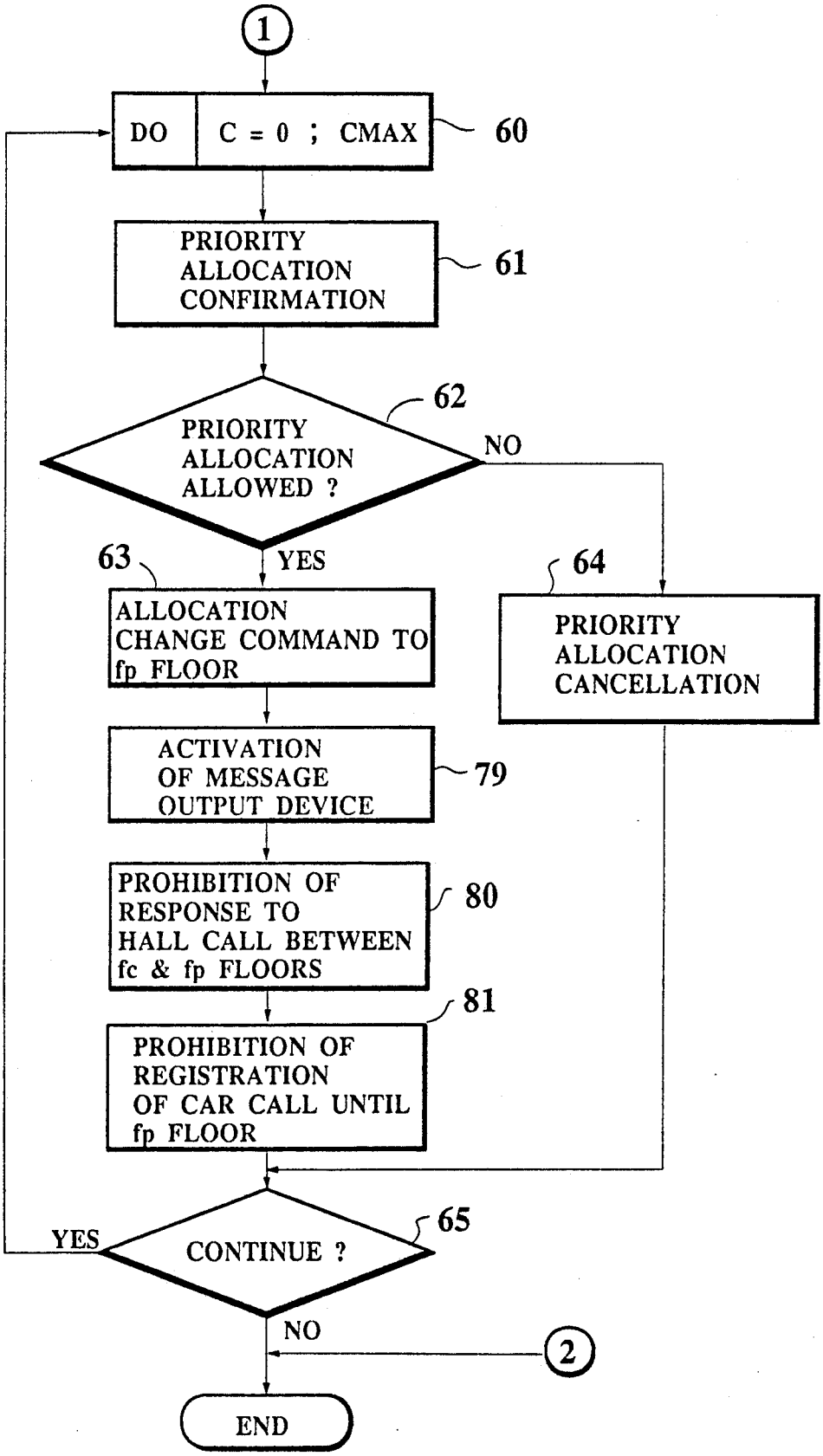

In accordance with the addition of the message output command unit 16 and the message output device 150, the operation of the group control unit 1-4 which is to be carried out according to the flow charts of FIGS. 16*a*, and 16*b* differs from the operation of the group control unit 1-3 of the third embodiment above in having additional step 79 between the steps 63 and 80, where at the step 79, a command to activate the message output device 150 is given from the message output command unit 16 to the elevator car control unit 102.

The other steps in FIGS. 16*a* and 16*b* substantially equivalent to those appeared in FIG. 10 for the third embodiment above.

Also, in accordance with the above described operation of the group control unit 1-4, the operation of the elevator car control circuit 2 which is to be carried out according to the flow chart of FIGS. 17*a* and 17*b* differs from that in the third embodiment above in having a step 71*a* instead of the step 71, where at the step 71*a*, the elevator car control circuit 2 not only reverse a direction of motion of the corresponding elevator car, as at the step 71, but also control the message output device 150 to output the appropriate audio and/or visual message inside the elevator car.

Figure 17:
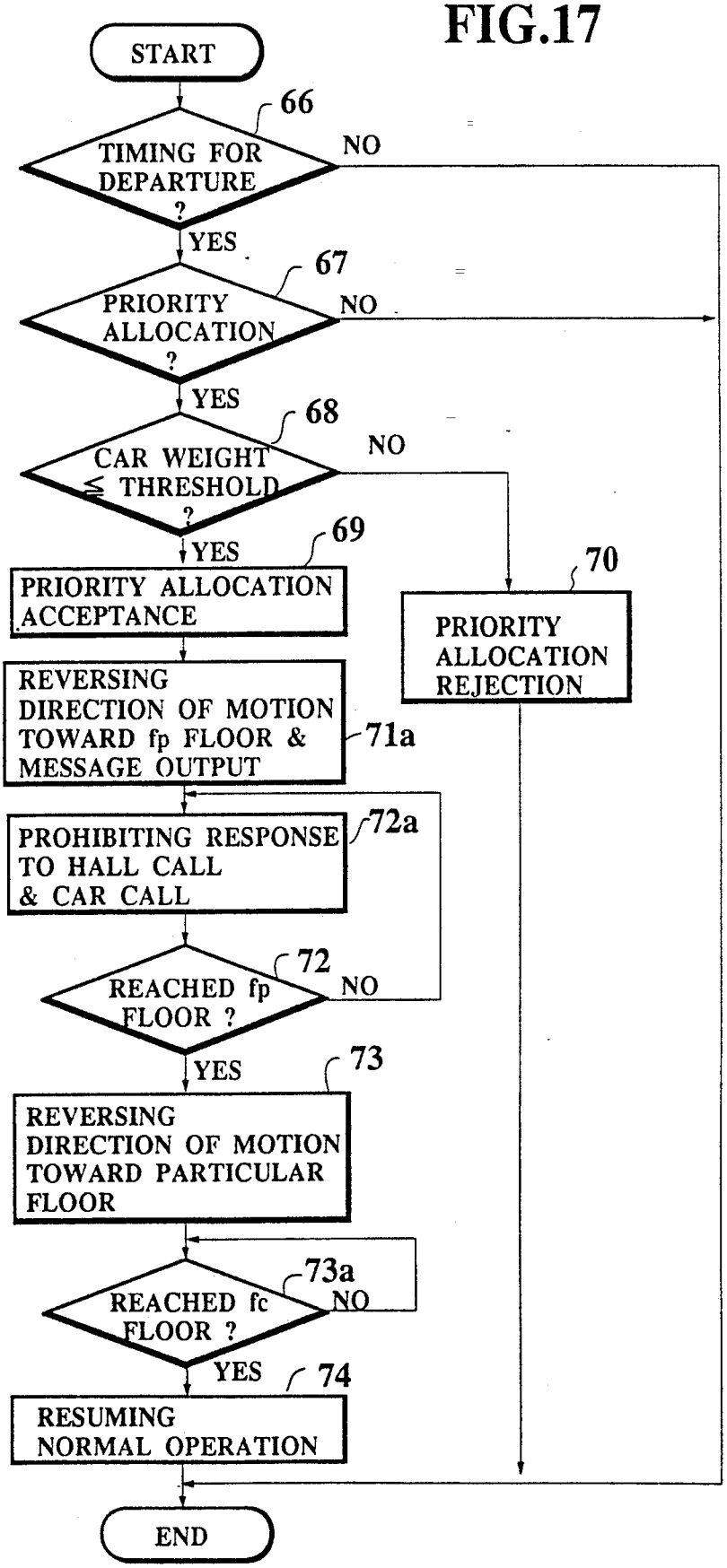
FIG. 17 is a flow chart for the operation of the elevator car control unit of FIG. 12.

The other steps in FIG. 17 are substantially equivalent to those appearing in FIG. 11 for the third embodiment above.

It should be obvious that this fourth embodiment can achieve the same effects as those described above for the third embodiment, and furthermore a further possibility of a lowering of the quality of service in the elevator system is prevented as already mentioned.

Figure 18:
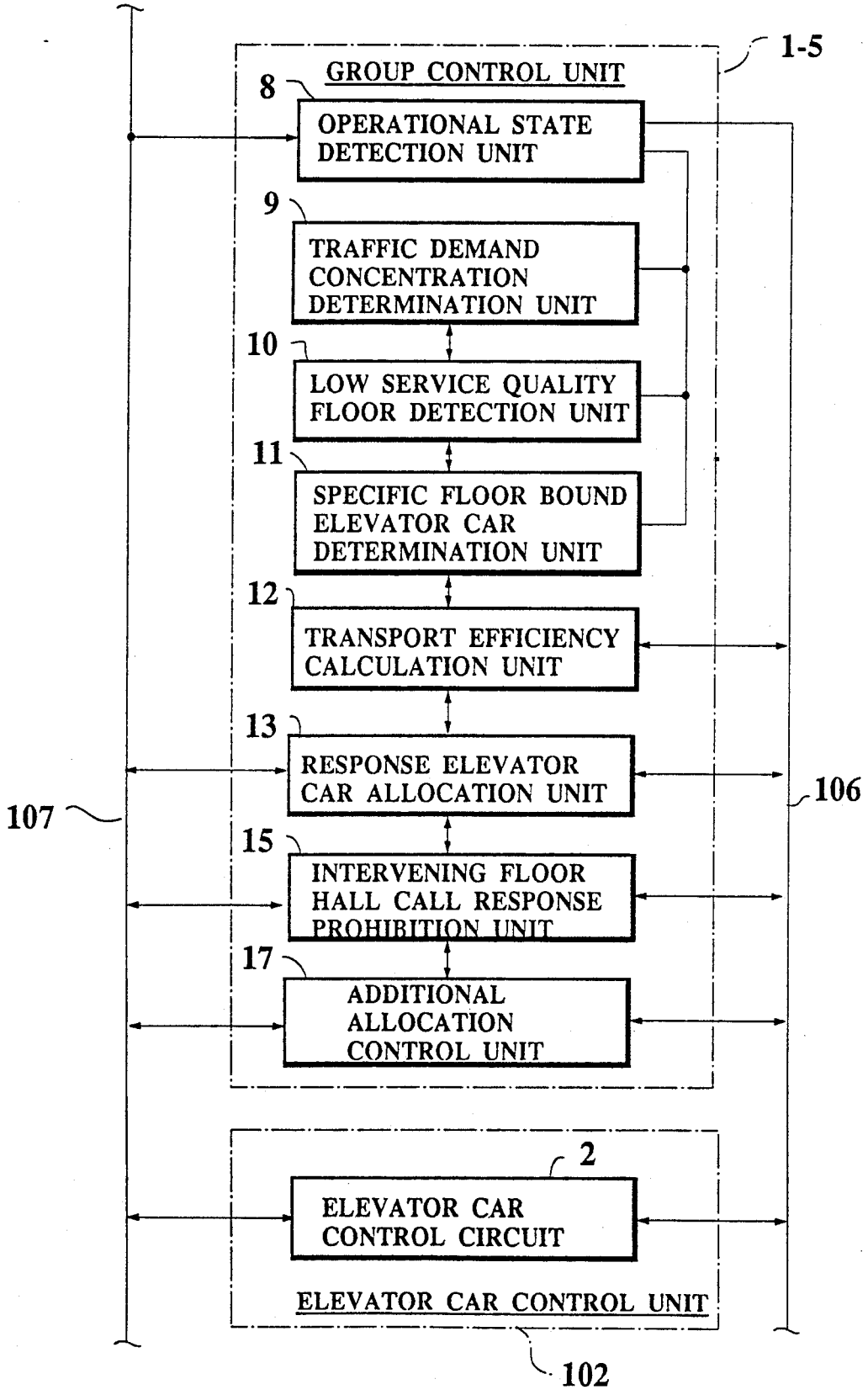
FIG. 18 is a block diagram of a group control unit an an elevator car control unit of a fifth embodiment of an elevator group control apparatus according to the present invention.

Referring now to FIG. 18, a fifth embodiment of an elevator group control apparatus according to the present invention will be described. In the following description, those elements which are substantially equivalent to the corresponding elements appeared in the third embodiment will be given the same labels and reference numerals in the figures, and their descriptions are omitted.

In this embodiment, the elevator group control apparatus has an overall configuration similar to that shown in FIG. 1 above, as in the first embodiment above, while the group control unit 1-5 of this embodiment differs from the group control unit 1-3 of the third embodiment above in having an additional element of an additional allocation control unit 17, which is connected with the high speed data transmission line 106, and low speed data transmission line 107, as can be seen in FIG. 18.

This additional allocation control unit 17 limits the number of additional allocations of the elevator car already operated by the priority allocation command to any hall call produces at floors which are further away from the particular floor than the fp floor, such that the confusion of the passengers inside the elevator car and the users at the hallway can be prevented. The additional allocation control unit 17 also limits the number of reversing of direction of motion for a given elevator car before the elevator car reaches to the particular floor, such that the passengers aboard the elevator car do not have to be kept inside the elevator car for a long time before the elevator car finally reaches to the particular floor.

Such an additional allocation control unit 17 is incorporated in this embodiment because, without such a limitation on the number of additional allocations, there is a possibility that the elevator car alreadly operated by the priority allocation command may respond to the other hall calls produced during its operation under the priority allocation command at the other floors which are further away from the particular floor than the fp floor, so that the passengers already aboard the elevator car from the start may have to wait for a long time before the elevator car reaches to the original desitination. The limitation provided by the additional allocation control unit 17 of this embodiment can effectively prevent the occurrence of such a situation.

Figures 19, 19A:
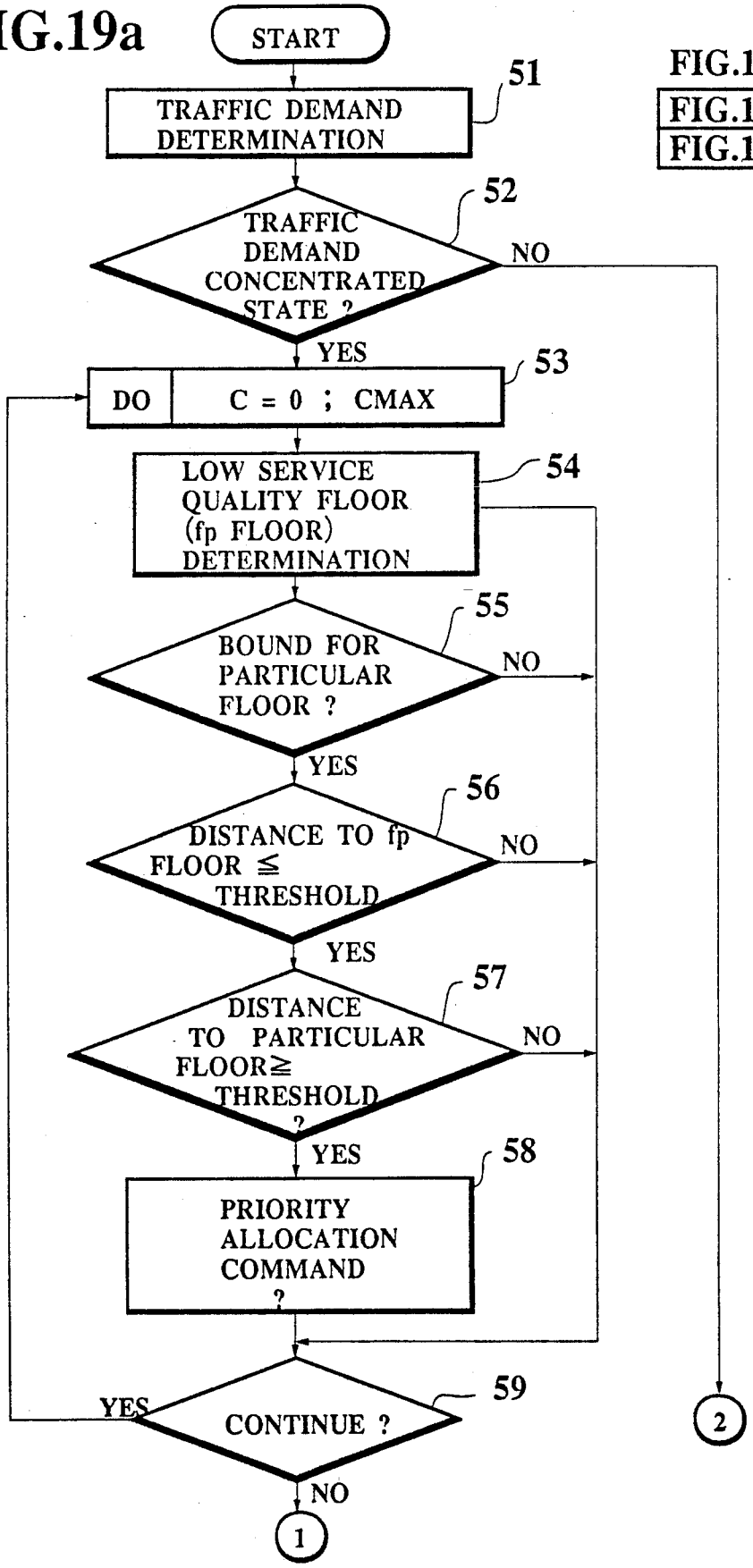
FIGS. 19*a* and 19*b* flow charts for the operation of the group control unit of FIG. 18.
Figure 19B:
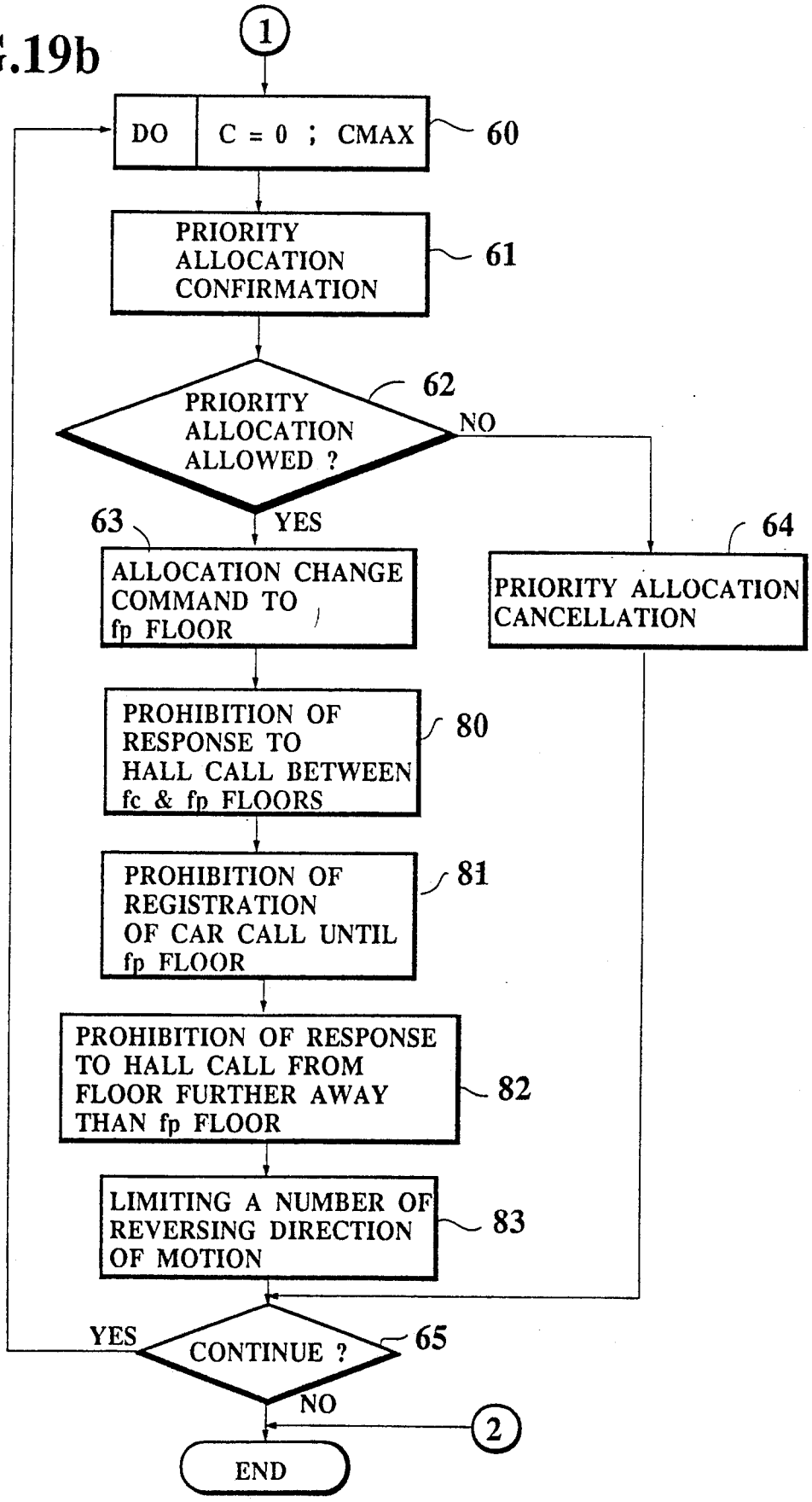

In accordance with the addition of the additional allocation control unit 17, the operation of the group control unit 1-5 which to be carried out according to the flow chart of FIGS. 19*a*, and 19*b* differs from the operation of the group control unit 1-3 of the third embodiment above in having additional steps 82 and 83 between the steps 81 and 65.

At the step 82, the additional allocation of any hall call in either direction from the the floor which area further away from the particular floor than the fp floor is limited. This limitation can be achieved by assuming the operational state of this elevator car as a state of this elevator before it is operated by the priority allocation command, i.e., a state when it is moving toward the particular direction from the fc floor, so that the further allocation becomes unlikely.

At the step 83, the number of reversing of the direction of motion by this elevator is limited. This limitation can be achieved by generating a reversing history of this elevator which is continuously checked until this elevator reaches to the particular floor.

The other steps in FIGS. 19*a* and 19*b* substantially equivalent ot those appearing in FIGS. 10*a* and 10*b* for the third embodiment above.

Figure 20:
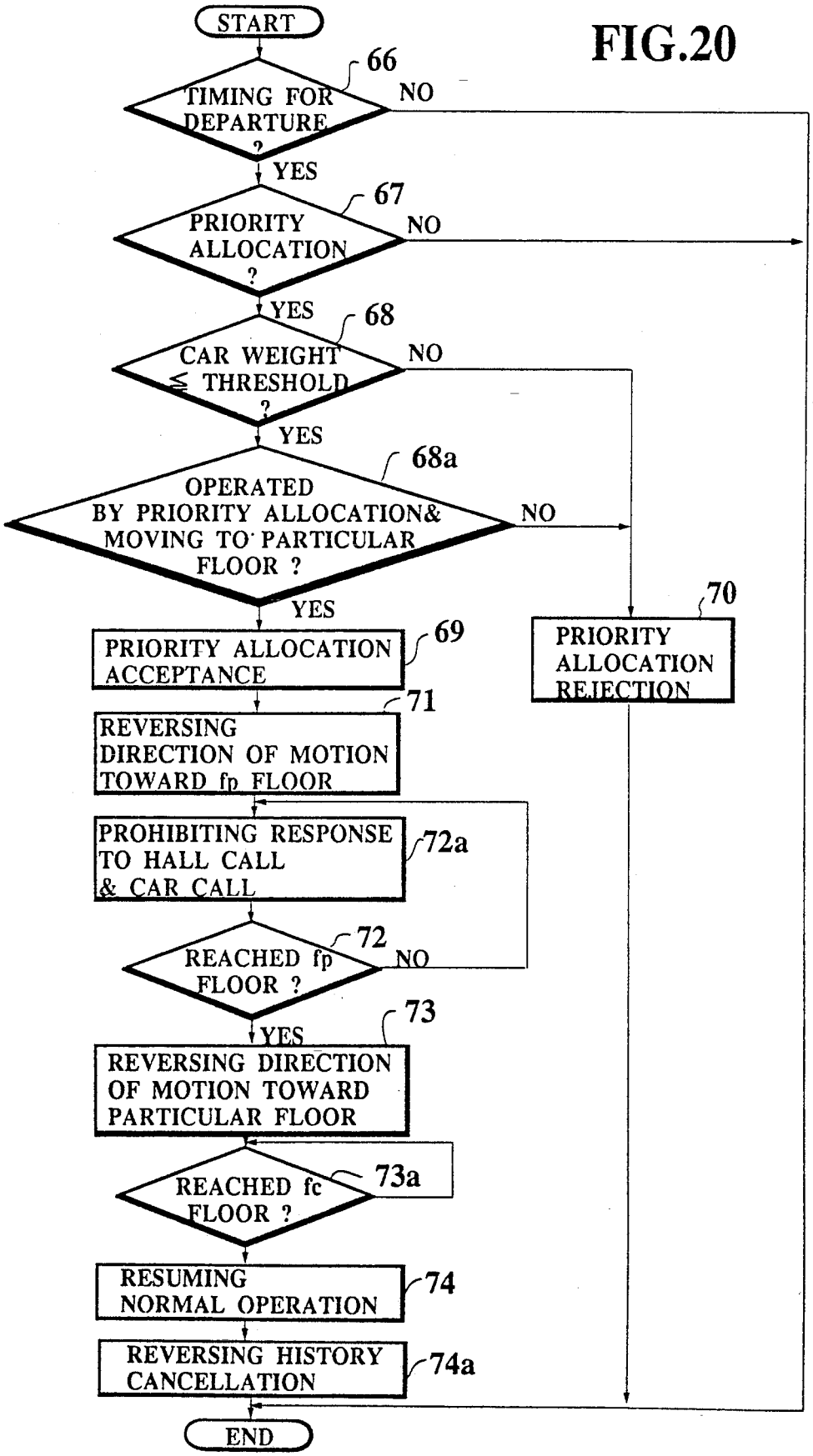
FIG. 20 is a flow chart for the operation of the elevator car control unit of FIG. 18.

Also, in accordance with the above described operation of the group control unit 1-5, the operation of the elevator car control circuit 2 which is to be carried out according to the flow chart of FIG. 20, differs from that in the third embodiment above in having additional steps 68*a* and 74*a*.

At the step 68*a*, whether this elevator car is operated by the priority allocation command and is moving to the particular floor from the fp floor or not is determined. This determination is acheieved by checking whether the reversing history for this elevator exist or not. If the reversing history does exist, the step 70 is taken next, so that the additional allocation is rejected, whereas if the reversing history does not exist, the step 69 is taken next.

As the step 74*a*, the reversing history for this elevator is cancelled as the elevator car reaches to the particular floor.

The other steps in FIG. 20 are substantially equivalent to those appearing in FIG. 11 for the third embodiment above.

Figure 21:
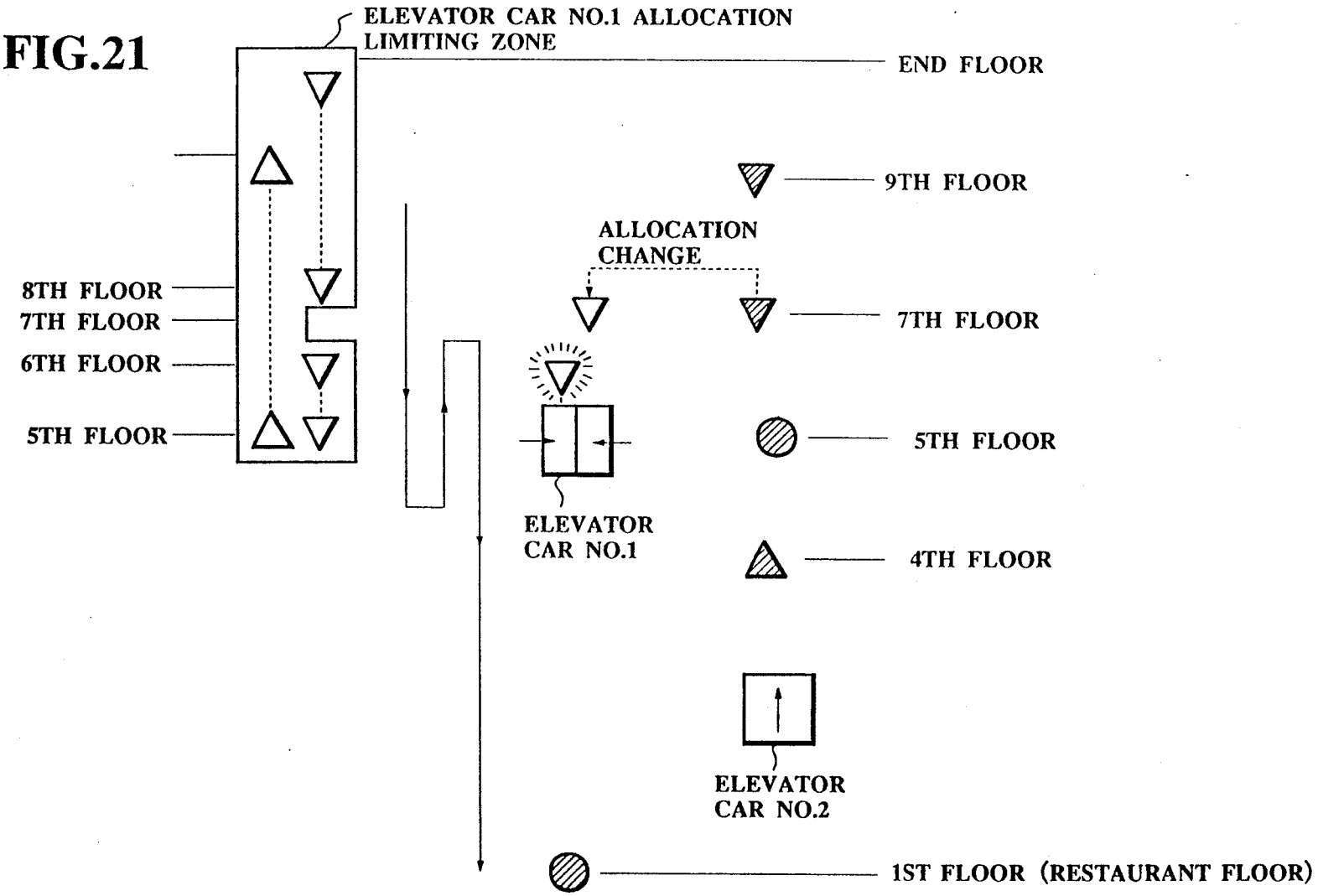
FIG. 21 is a diagrammatic illustration of an elevator system controlled by the group control unit of FIG. 18 for explaining its operation.

Thus, in this embodiment, the elevator car operated by the priority allocation command do not respond to any hall call or car call while it moves from the fc floor to the fp floor and comes back to the level of the fc floor, and also to any hall call from a floor opposite from the particular floor with respect to the fp floor, as shown in FIG. 21, while the number of reversing is also limited. As a result, the confusion of the passengers inside the elevator car and the users at the hallway due to the seemingly confusing motion of the elevator car can be prevented, while the passengers aboard the elevator car do not have to be kept inside the elevator car for a long time before the elevator car finally reaches to the particular floor.

It should be obvious that this fifth embodiment can achieve the same effects as those described above for the third embodiment, and furthermore a further possibility of a lowering of the quality of service in the elevator system is prevented as already mentioned.

It is to be noted that in the fifth embodiment above, the elevator car may be controlled to respond to the car call while it is moving to the fp floor, if desired.

Also, instead of using the reversing history, the limitation of the number of reversing may be achieved by simply limiting the allocation of the hall call.

Furthermore, the number of reversing may be limited to any other appropriate number different from the above embodiment, if desired.

It is also to be noted that although in the above embodiments, the traffic demand concentration determination unit 9 of the group control unit 1 determines a situation of the traffic demand concentration on a basis of data on the operational state of the elevator cars such as car call registration, this determination of a situation of the traffic command concentration may be made on a basis of current time, where a particular period of time is designated as a time of the traffic demand concentration.

Besides these, many modifications and variations of the above embodiments may be made without departing from the novel and advantageous features of the present invention. Accordingly, all such modifications and variations are intended to be included within the scope of the appended claims.

What is claimed is:

1. An elevator group control apparatus for controlling an elevator system including a plurality of elevator cars and a plurality of floors, comprising:

group control means for performing a hall call allocation control to determine a response elevator car to respond to a hall call produced at one of the floors among the elevator cars of the elevator system, the response elevator car being one of the elevator cars whose allocation results in a highest transport efficiency in the elevator system; and elevator car control means for controlling the elevator cars of the elevator system according to the hall call allocation control, such that on condition that the response elevator car having an ultimate destination floor is additionally allocated to another floor which is located in an opposite direction from an ultimate destination of the response elevator car, the response elevator car is controlled to reverse a direction of motion to serve said another floor and then to reverse the direction of motion again to move to the ultimate destination floor.

2. The apparatus of claim 1, wherein the group control means additionally allocates the response elevator car having the ultimate destination floor to said another floor on condition that a quality of service with respect to said another floor is low.

3. The apparatus of claim 1, wherein the group control means performs the hall call allocation control according to current traffic demands in the elevator system.

4. The apparatus of claim 3, wherein the group control means additionally allocates the response elevator car having the ultimate destination floor to said another floor on condition that traffic demands in the elevator system is concentrated to the ultimate destination of the response elevator car.

5. The apparatus of claim 1, wherein, another elevator car different from the response elevator car has already been allocated to said another floor before the response elevator car is determined, the group control means also cancels an allocation of said another elevator car and newly allocate the response elevator car to said another floor.

6. The apparatus of claim 1, wherein the group control means also limits a number of the elevator cars to be controlled to reverse the direction of motion by the elevator car control means simultaneously.

7. The apparatus of claim 1, wherein the group control means also prohibits the response elevator car from responding to any other hall call produced at a floor between a starting position of the response elevator car and said another floor, while the response elevator car is moving to said another floor by reversing the direction of motion.

8. The apparatus of claim 1, wherein the group control means also prohibits the response elevator car from responding to any hall call produced at a floor between a starting position of the response elevator car and said another floor, when no car call has been registered for said floor in the response elevator car, while the response elevator car is movimg from said another floor by reversing the direction of motion again.

9. The apparatus of claim 1, wherein the group control means also prohibits the response elevator car from responding to any other car call between a starting position of the response elevator car and said another floor, while the response elevator car is moving to said another floor by reversing the direction of motion.

10. The apparatus of claim 1, further comprising means for notifying passengers inside the response elevator car about a reverse motion of the response elevator car, while the response elevator car is moving to said another floor by reversing a direction of motion.

11. The apparatus of claim 1, wherein the group control means also limits an additional allocation of the response elevator car to other hall calls produced at floors which are further away from the ultimate destination floor than said another floor.

12. The apparatus of claim 1, wherein the group control means also limits an additional allocation of the response elevator car to other car calls to floors located which are further away from the ultimate destination floor than said another floor.

13. The apparatuse of claim 1, wherein the group control means also limits a number of reversing of the direction of motion by the response elevator car to be made before the response elevator car reaches the ultimate destination floor.

14. The apparatus of claim 1, wherein the group control means includes:

operational state detection means for detecting operational states of the elevators;

traffic demand concentration determination means for determining whether the elevator system is in a state in which traffic demands in the elevator system are concentrated to a particular floor, in accordance with the operational states detected by the operational state detection means;

low service quality floor determination means for determining a low service quality floor with respect to which a quality of service is lower than other floors, when the traffic demand concentration determination means determines that the trafic demands in the elevator system are concentrated to the particular floor;

reversible elevator car selection means for selecting reversible elevator cars which are to be moved in a direction of the particular floor and are located between the particular floor and the low service quality floor;

transport efficiency calculation means for calculating transport efficiencies resulting from an allocation of each of the reversible elevator cars selected by the reversible elevator car selection means by reversing a direction of motion of the reversible elevator cars; and response elevator car determination means for determining the response elevator car among the reversible elevator cars selected by the reversible elevator car selection means, for which the transport efficiency calculated by the transport efficiency calculation means is highest.

15. The apparatus of claim 14, wherein, on condition that another elevator car different from the response elevator car has already been allocated to the hall call from the low service quality floor before the response elevator car is determined, the response elevator car determination means also cancels an allocation of said another elevator car and newly allocate the response elevator car to the low service quality floor.

16. The apparatus of claim 14, wherein the group control means further includes means for limiting a number of the elevator cars to be controlled to reverse the direction of motion by the elevator car control means simultaneously.

17. The apparatus of claim 14, wherein the group control means further includes means for prohibiting the response elevator car from responding to any other hall call produced at a floor between a starting position of the response elevator car and the low service quality floor, while the response elevator car is moving to the low service quality floor by reversing the direction of motion.

18. The apparatus of claim 14, wherein the group control means further includes means for prohibiting the response elevator car from responding to any other hall call produced at a floor between a starting position of the response elevator car and the low service quality floor, when no car call has been registered for said floor in the response elevator car, while the response elevator car is moving from the low service quality floor by reversing direction of motion again.

19. The apparatus of claim 14, wherein the group control means further includes means for prohibiting the response elevator car from responding to any other car call between a starting position of the response elevator car and the low service quality floor, while the response elevator car is moving to the low service quality floor by reversing the direction of motion.

20. The apparatus of claim 14, further comprising means for notifying passengers inside the response elevator car about a reverse motion of the response elevator car, while the response elevator car is moving to the low service quality floor by reversing a direction of motion.

21. The apparatus of claim 14, wherein the group control means further includes means for limiting an additional allocation of the response elevator car to other hall calls produced at floors which are further away from the ultimate destination floor than the low service quality floor.

22. The apparatus of claim 14, wherein the group control means further includes means for limiting an additional allocation of the response elevator car to other car calls to floors which are located further away from ultimate destination floor than the low service quality floor.

23. The apparatus of claim 14, wherein the group control means further includes means for limiting a number of reversing of the direction of motion by the response elevator car to be made before the response elevator car reaches the ultimate destination floor.

* * * * *